US007114201B2

(12) United States Patent
Matsunaga et al.

(10) Patent No.: US 7,114,201 B2
(45) Date of Patent: Oct. 3, 2006

(54) AUTOMATIC SHAMPOO MACHINE

(75) Inventors: Hideaki Matsunaga, Moriguchi (JP); Takenari Yuki, Moriguchi (JP); Tatsuhiko Yoshii, Moriguchi (JP); Tomo Nishimura, Moriguchi (JP); Masaru Noro, Moriguchi (JP); Masatsugu Ito, Osaka (JP)

(73) Assignees: Sanyo Electric Co., LTD, Osaka (JP); Takara Belmont Corp., Osaka (JP); Sanyo Electric Techno Clean Co., LTD, Osaka (JP)

( * ) Notice: Subject to any disclaimer, the term of this patent is extended or adjusted under 35 U.S.C. 154(b) by 93 days.

(21) Appl. No.: 10/489,769

(22) PCT Filed: Sep. 27, 2002

(86) PCT No.: PCT/JP02/10114

§ 371 (c)(1),
(2), (4) Date: Mar. 17, 2004

(87) PCT Pub. No.: WO03/028501

PCT Pub. Date: Apr. 10, 2003

(65) Prior Publication Data

US 2004/0255374 A1 Dec. 23, 2004

(30) Foreign Application Priority Data

Sep. 28, 2001 (JP) ..... 2001-303809
Oct. 2, 2001 (JP) ..... 2001-306844
Aug. 9, 2002 (JP) ..... 2002-233835

(51) Int. Cl.
*A45D 19/00* (2006.01)

(52) U.S. Cl. ..... 4/515; 4/516; 4/517; 4/519; 4/523

(58) Field of Classification Search ..... 4/515–523, 4/535, 537
See application file for complete search history.

(56) References Cited

U.S. PATENT DOCUMENTS 3,934,596 A * 1/1976 Suntheimer et al. ..... 4/518
4,407,028 A * 10/1983 Nolan ..... 4/516
4,841,584 A * 6/1989 Overcash et al. ..... 4/519
5,054,474 A * 10/1991 Jacob et al. ..... 4/541.6
5,896,595 A * 4/1999 Spencer ..... 4/519
5,906,012 A * 5/1999 Sakane et al. ..... 4/515
5,996,137 A * 12/1999 Genova ..... 4/498
2003/0177571 A1* 9/2003 Tadaka et al. ..... 4/522

FOREIGN PATENT DOCUMENTS

JP 5-192215 8/1993
JP 6-217821 8/1994

(Continued)

*Primary Examiner*—Khoa D. Huynh
(74) *Attorney, Agent, or Firm*—Rabin & Berdo P.C.

(57) ABSTRACT

An automatic shampoo machine used in beauty salons and the like, having improved operability and including a manual finish hair rinsing operation. A basin is provided with a hand shower and a hand shower valve to be operated by an operator standing behind, a hood for covering and uncovering the top of the basin and an open/close unit for opening/closing and moving the hood. The open/close unit guides the hood to a closing position, a first opening position and a second opening position. In the first position the hood is in an upright state behind the basin, and in the second position the hood is positioned on the left side of the basin. In the second position, the hood uncovers the rear side of the basin, whereby the operator can perform operations from the rear side of the basin without the hood interfering.

14 Claims, 24 Drawing Sheets

FOREIGN PATENT DOCUMENTS

| | | |
|---|---|---|
| JP | 7-289346 | 11/1995 |
| JP | 11-187919 | 7/1999 |
| JP | 11-187920 | 7/1999 |

* cited by examiner

AUTOMATIC SHAMPOO MACHINE

TECHNICAL FIELD

The present invention relates to an automatic shampoo machine for business use in barbershops, beauty salons and the like.

PRIOR ART

An automatic shampoo machine is typically adapted to perform a shampooing operation by spouting warm water over the head and hair of a person being shampooed with the person's head positioned upward in a basin. At this time, the top of the basin is covered with a hood for prevention of leakage of the spouted warm water to the outside. The hood is pivotal about its rear portion for covering and uncovering the top of the basin.

When an operator such as a barber or a beautician uses the automatic shampoo machine, the operator opens and closes the hood to assist the person to set the person's head in the basin. After closing the hood with the person's head positioned in the basin, the operator operates an operation panel to start an automatic shampooing operation.

After completion of the automatic shampooing operation, the operator may manually perform a finish rinsing operation on the person's hair with the use of a hand shower.

Further, the operator may manually perform a hair dyeing operation on the person's hair with the use of a hair dye or the like.

Thus, the operator operates the automatic shampoo machine, assists the person, and performs the manual operations on the person in association with the operation of the automatic shampoo machine.

With the conventional automatic shampoo machine, the operator can perform the operations only from a diagonally front side or a lateral side of the person, particularly when the hood is open. This is because the opened hood projects rearwardly upward from the basin thereby to hinder the operator from performing the operations from a rear side where the operator can see the person's parietal portion well.

Further, it is desired that the hood and other components are located out of the way of the operator's operations when the operator performs the operations on the person.

Further, the automatic shampoo machine is desirably easy to operate for the operator.

DISCLOSURE OF THE INVENTION

In view of the foregoing, it is a major object of the present invention to provide an automatic shampoo machine which is easy to operate for an operator and ensures a comfortable automatic shampooing operation and an easy manual operation.

It is another object of the present invention to provide an automatic shampoo machine which ensures that an operator can stand behind a basin to perform an operation on a person being shampooed.

According to the present invention, there is provided an automatic shampoo machine for automatically performing a shampooing operation by spouting a cleaning liquid over a head and hair of a person being shampooed with the person's head positioned upward in a basin, the automatic shampoo machine comprising: a basin configured so that an operator can stand behind the person's head for performing an operation; and a component disposed in the vicinity of the basin at a position which is out of the way of the operator when the operator stands behind the person's head to perform the operation.

With this arrangement, the operator can perform a treatment and an operation on the person and operate the automatic shampoo machine from the rear side of the person's head, i.e., from the rear side of the automatic shampoo machine. From the rear side of the person, the operator can perform the treatment and the operation without oppressing the person while checking the states of the person's head and hair, particularly the states of lateral portions of the person's head and hair.

Therefore, the automatic shampoo machine ensures that the operator can easily perform the operation associated with the automatic shampooing operation, and the person can comfortably be subjected to the operation.

The basin has an open top and an indentation (neck portion) provided on a front upper edge thereof for receiving a neck of the person assuming a supine attitude, and is preferably configured so that at least a rear peripheral portion thereof is free from a projection which may otherwise hinder the operator when the operator stands behind the basin.

Since the basin has such a shape, the operator can easily perform the operation.

The basin is preferably configured so that at least a rear peripheral surface thereof comprises a round surface. More preferably, the basin is configured so that an outer periphery thereof is generally circular as seen in plan.

Since the basin has such an outer peripheral shape, the operator can easily stand behind the basin and easily perform the operation.

Further, the basin is configured so that at least the rear peripheral surface thereof has an outer diameter increasing upward. Where the size of the basin progressively increases from its lower portion to its upper portion, the shampooing operation can easily be performed in the basin having the open top. Further, the operator can easily perform the operation when standing behind the basin.

The basin is preferably a ceramic basin. The ceramic basin has an improved chemical resistance, and is less liable to cause water splashing noises. Further, the texture of the interior and exterior surfaces of the ceramic basin gives a favorable impression to the person and, together with the mechanical arrangement of the automatic shampoo machine, provides a novel aesthetic design. This design feature of the machine attracts the person to be shampooed and the operator.

Further, the basin is located at a height of an operator's waist when the operator stands behind the basin.

Thus, the operator can perform the operation without stooping, so that the operation efficiency for the operator is improved.

Further, at least a lower rear portion of the basin is covered with a cone-shaped housing which has an outer diameter decreasing downward.

Since the lower portion of the basin is covered with the cone-shaped housing having the outer diameter decreasing downward, the operator can easily stand behind the basin without interference between the housing and the operator's toes and between the housing and the operator's knees when the operator slightly stoops.

The component of the automatic shampoo machine comprises a hood for covering and uncovering the top of the basin. The hood is movable to a retracted position away from a rear upper side of the basin when it is opened.

With this arrangement, the open hood does not cause any inconvenience when the operator stands behind the person's head to perform the operation.

The machine preferably further comprises an open/close unit for opening and closing the hood with respect to a rear portion of the basin so that a front portion of the hood is lifted pivotally about a rear portion of the hood and, after the hood is opened, sliding the hood laterally of the basin along the outer periphery of the basin.

With the provision of the open/close unit, the hood can smoothly be moved to the retracted position.

It is convenient that the open/close unit is guided slidably along a guide rail fixed to the outer periphery of the basin.

At this time, where the outer periphery of the basin has a round surface, the open/close unit can more smoothly be guided by the guide rail.

The component of the automatic shampoo machine comprises an agent container which contains an agent such as a shampoo liquid or a treatment liquid to be used for the shampooing operation, and the agent container is disposed in a free space below the basin on the lateral.

With this arrangement, the agent container does not hinder the operator's operation. Since the agent container is disposed in the free space below the basin on the lateral, it is advantageous that the operator can easily perform operations such as the replenishing of the agent container with the agent, or the like.

The component of the automatic shampoo machine preferably further comprises a hand shower and a hand shower valve, which are disposed on a flat portion provided inwardly of a rear upper edge of the basin.

The flat portion is located between the person and the operator standing behind the person's head, and the hand shower and the hand shower valve are provided on the flat portion. Therefore, the operator can easily operate the hand shower and the hand shower valve, and easily perform an auxiliary shampooing operation on the person with the use of the hand shower.

The component of the automatic shampoo machine comprises an operation panel for the automatic shampoo machine. The operation panel is disposed in the vicinity of a lateral portion of the basin. The operation panel is preferably water-proof.

With this arrangement, the operator standing behind the person's head can easily operate the operation panel.

The operation panel may be provided in the form of a remote controller. The operation panel provided in the form of the remote controller in the predetermined position can be detached when required, and used at an easy-to-operate position by the operator.

The operation panel is preferably supported on an upper end of a support post projecting upward.

By supporting the operation panel on the special support post, the operation panel can more flexibly be laid out. Thus, the shape of the basin can flexibly be designed. In addition, the operation panel can be located at an easy-to-operate position and height for the operator in the vicinity of the basin irrespective of the shape of the basin.

The automatic shampoo machine may further comprise a seat provided in front of the basin for seating the person thereon.

With the provision of the seat in the automatic shampoo machine, the head of the person seated on the seat can smoothly be received in the basin. In other words, the person's head can easily be positioned in the basin when being received upward in the basin for the automatic shampooing operation. Since the seat is attached to the basin in predetermined positional relation, the person's head can properly be position with respect to the basin simply by seating the person on the seat.

In the automatic shampoo machine, the seat is separable from a main body including the basin, and is preferably combined with the main body at an installation site.

Where the seat is integrated in the automatic shampoo machine, the automatic shampoo machine has an increased overall size, and is difficult to handle in the shipping and transportation thereof. By separately providing the seat and the main body including the basin, the automatic shampoo machine can easily be inspected and handled before the installation thereof at an installation site such as a beauty salon.

The seat and the main body are combined together when being installed in the beauty salon. Therefore, the automatic shampoo machine ensures comfortable automatic shampooing operation for the person being shampooed and easy operation for the operator.

The respective components of the automatic shampoo machine are preferably provided in the main body but not incorporated in the seat.

With this arrangement, the components provided in the main body can easily be inspected in the production of the machine. Further, there is no need for electrically connecting the main body with the seat in the assembling of the machine at the installation site.

EMBODIMENTS OF THE INVENTION

Embodiments of the present invention will hereinafter be described specifically with reference to the drawings.

Figure 1:
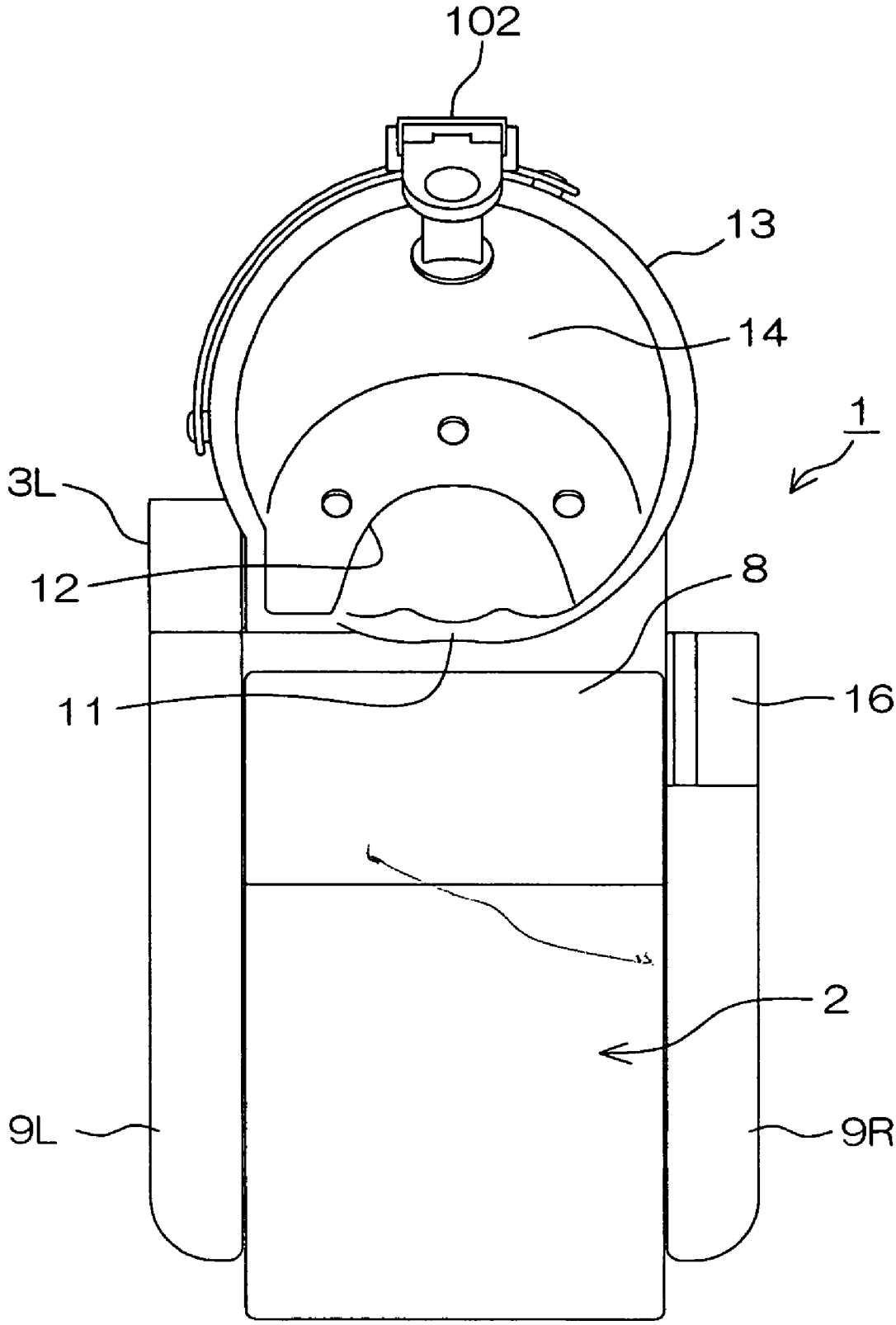
FIG. 1 is a plan view illustrating the exterior of an automatic shampoo machine according to one embodiment of the present invention.
Figure 2:
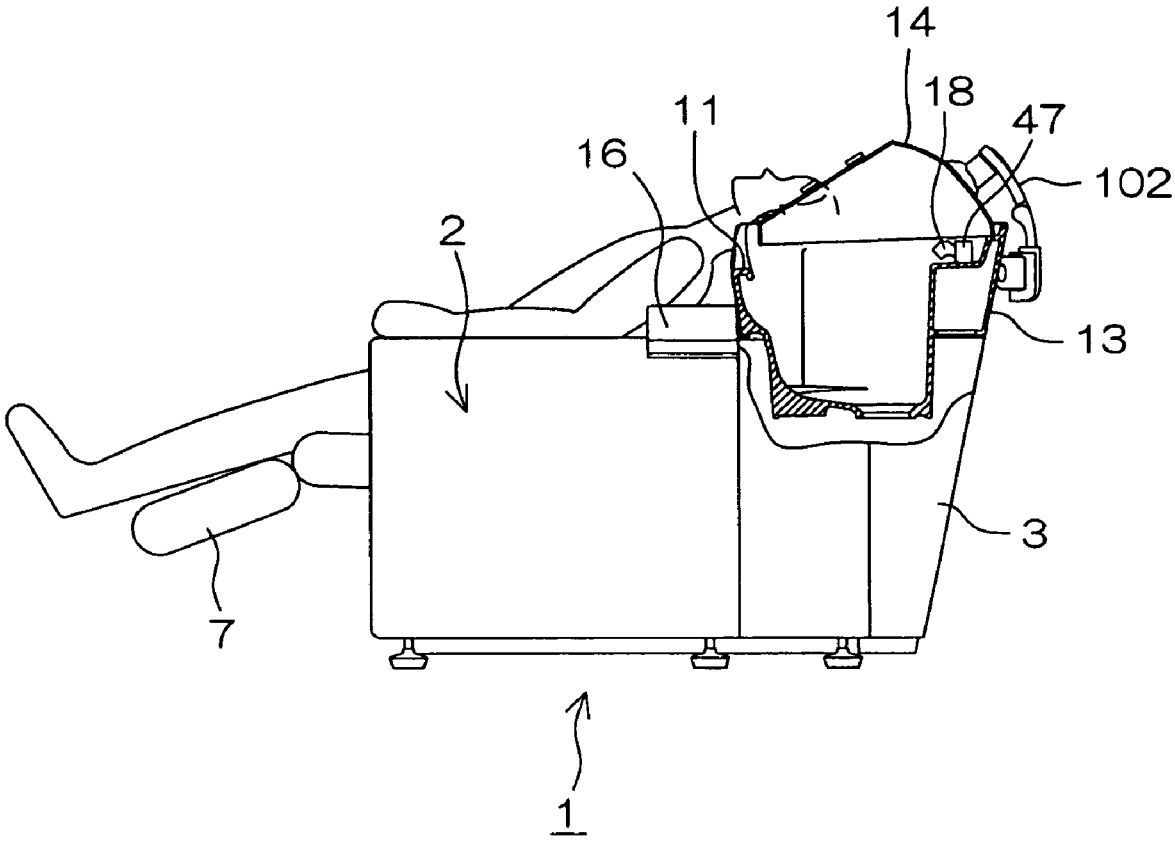
FIG. 2 is a right side view illustrating the automatic shampoo machine according to the embodiment of the invention in a state where a person is shampooed, wherein the internal construction of the machine is partly illustrated by a broken line.

FIG. 1 is a plan view illustrating the exterior of an automatic shampoo machine according to one embodiment of the present invention. FIG. 2 is a right side view illustrating the automatic shampoo machine in a state where a person is shampooed, wherein the internal construction of the machine is partly illustrated by a broken line.

The automatic shampoo machine 1 includes a seat 2 for seating the person thereon in a shampooing operation, a basin 13 disposed on a rear upper side of the seat 2, and a cone-shaped housing 3 which covers a rear lower portion of the basin 13. These components are integrated.

The basin 13 has an open top, and includes a neck portion 11 provided on a front edge thereof for receiving the person's neck rested thereon. The neck portion 11 is of a downwardly concave shape, and has a predetermined width as anteroposteriorly measured for receiving the person's neck.

The top of the basin 13 is covered with a hood 14. The hood 14 is of an upwardly convex shape, and has an opening 12 provided on its front side for exposing the person's face in the shampooing operation. The hood 14 can be opened and closed with respect to the basin 13 by an open/close unit 102 provided behind the hood.

With the person seated on the seat 2 for the shampooing, a leg-rest 7 is lifted as a back-rest 8 is reclined rearward. The person seated on the seat 2 can assume a relaxed attitude with the person's head being positioned upward in the basin 13. Then, the hood 14 is closed, and an automatic shampooing operation is performed with the person's face being exposed from the opening 12 of the hood 14.

An operator (a barber or a beautician of a barbershop or a beauty salon in which the automatic shampoo machine 1 is installed) performs an operation for opening and closing the hood 14, an operation for reclining the seat 2, and an operation for starting the automatic shampooing operation. The operation for opening and closing the hood 14 is manually performed as will be described later. The operation for reclining the seat 2 can be, for example, electrically performed by operating an operation panel 16 incorporated in a rear left upper portion of the seat 2 (a rear upper portion of a left arm-rest). The operation panel 16 is preferably water-proof, and free from troubles in its operation and performance even if water droplets are splashed over the operation panel. Though not shown, the operation panel 16 includes a variety of buttons for the automatic shampooing operation in addition to buttons for the reclining of the seat 2. The operation panel 16 is generally provided in a manner such that the operator can easily operate the operation panel.

More specifically, the operation panel is disposed in the rear lateral upper portion of the seat 2 in the vicinity of the basin 13 as described above. The operator can stand around the basin 13 to open and close the hood 14, to recline the seat 2 and to assist the person to position the person's head in the basin 13 and, after the completion of the automatic shampooing operation, to manually perform a finish hair rinsing operation and a hair dyeing operation on the person. Since the operation panel 16 is disposed in the vicinity of the basin 13, the buttons on the operation panel 16 and the like can easily be operated.

Figure 3:
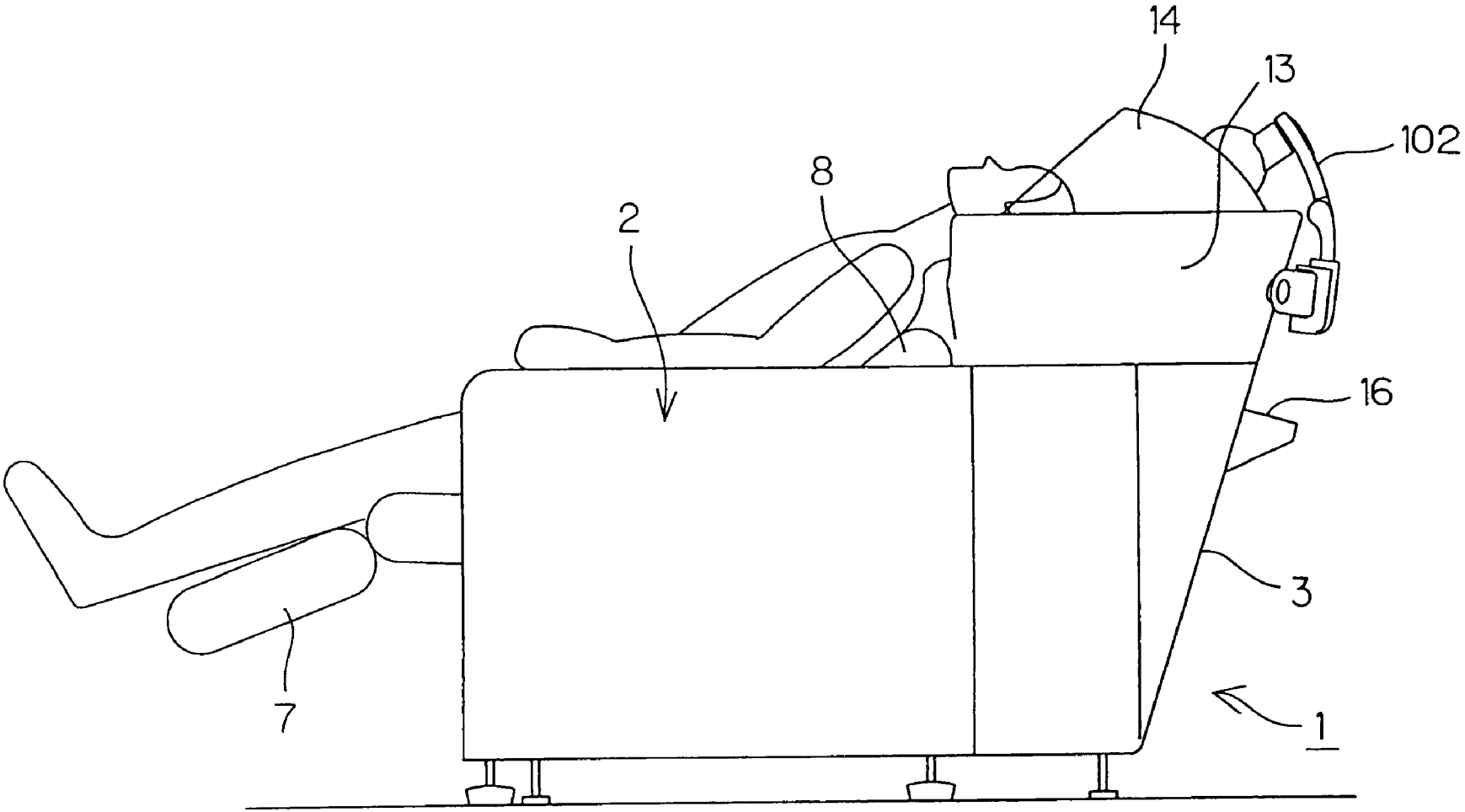
FIG. 3 is a side view illustrating the position of an operation panel provided in the automatic shampoo machine by way of an example.

The position of the operation panel 16 is not limited to the position shown in FIGS. 1 and 2, but the operation panel may be disposed on a lateral side of the cone-shaped housing 3 as shown in FIG. 3.

Figure 4:
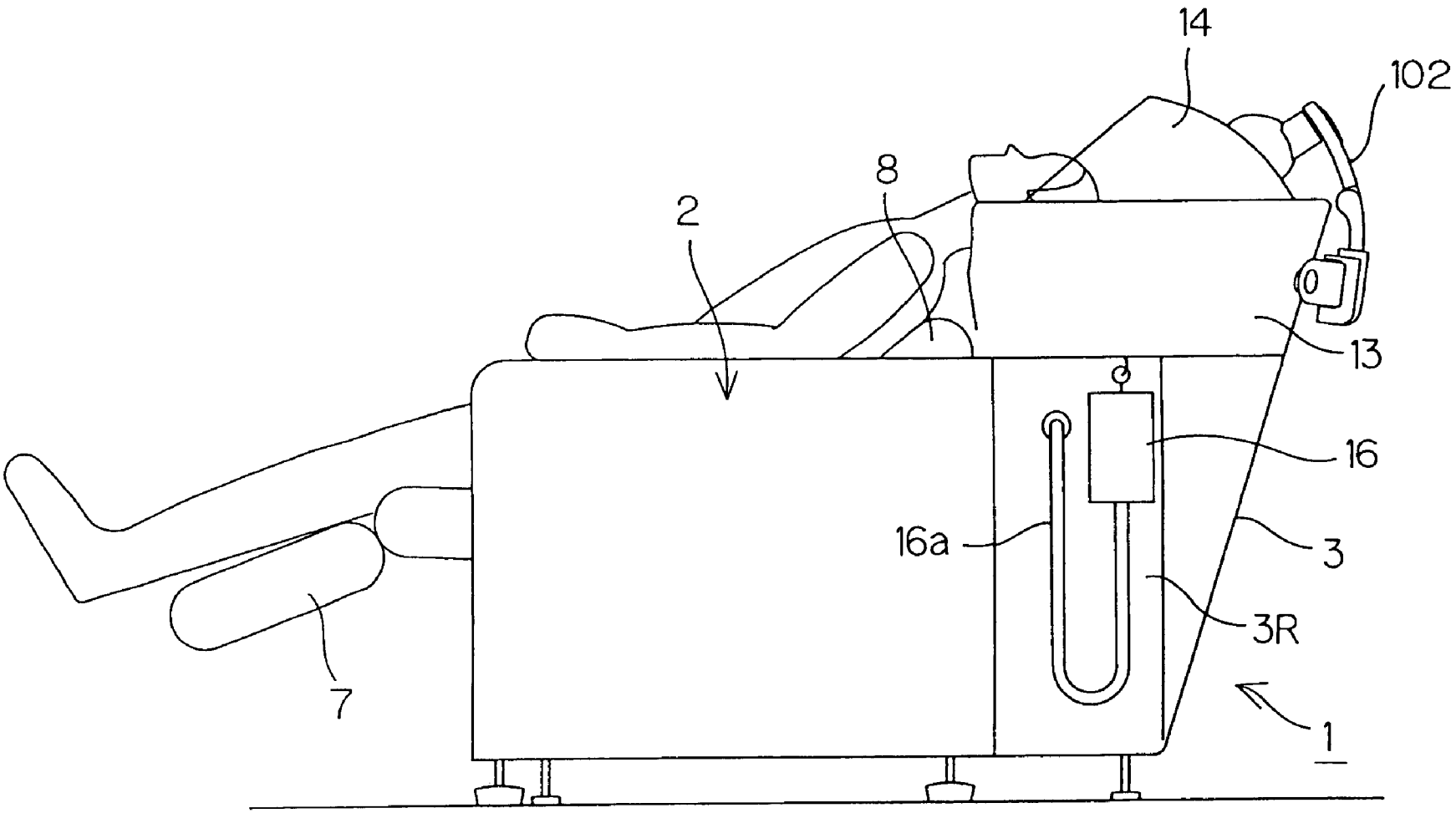
FIG. 4 is a side view illustrating another example of the operation panel.

The operation panel 16 may be provided in the form of a wired remote controller electrically connected to the inside of the machine by a wire 16*a* as shown in FIG. 4. In this case, the operation panel 16 may be hooked on a hook, for example, provided on a right housing 3R which covers the lower portion of the basin 13. For the operation of the operation panel 16, the operator can detach the operation panel 16 from the hook. Therefore, the operator can easily operate the operation panel while standing behind the basin 13. When the operator does not operate the operation panel, the operation panel can be hooked at a position out of the way of the operator.

The operation panel 16 is not limited to the wired remote controller, but may be provided in the form of a wireless remote controller. The position of the operation panel 16 provided in the form of the remote controller is not limited to the position shown in FIG. 4, but the operation panel may be provided on a side face of the cone-shaped housing 3 or at any other position. The operation panel in the form of the remote controller is not necessarily required to be hooked on the hook, but may be accommodated, for example, in a recess provided on the housing.

Figure 5:
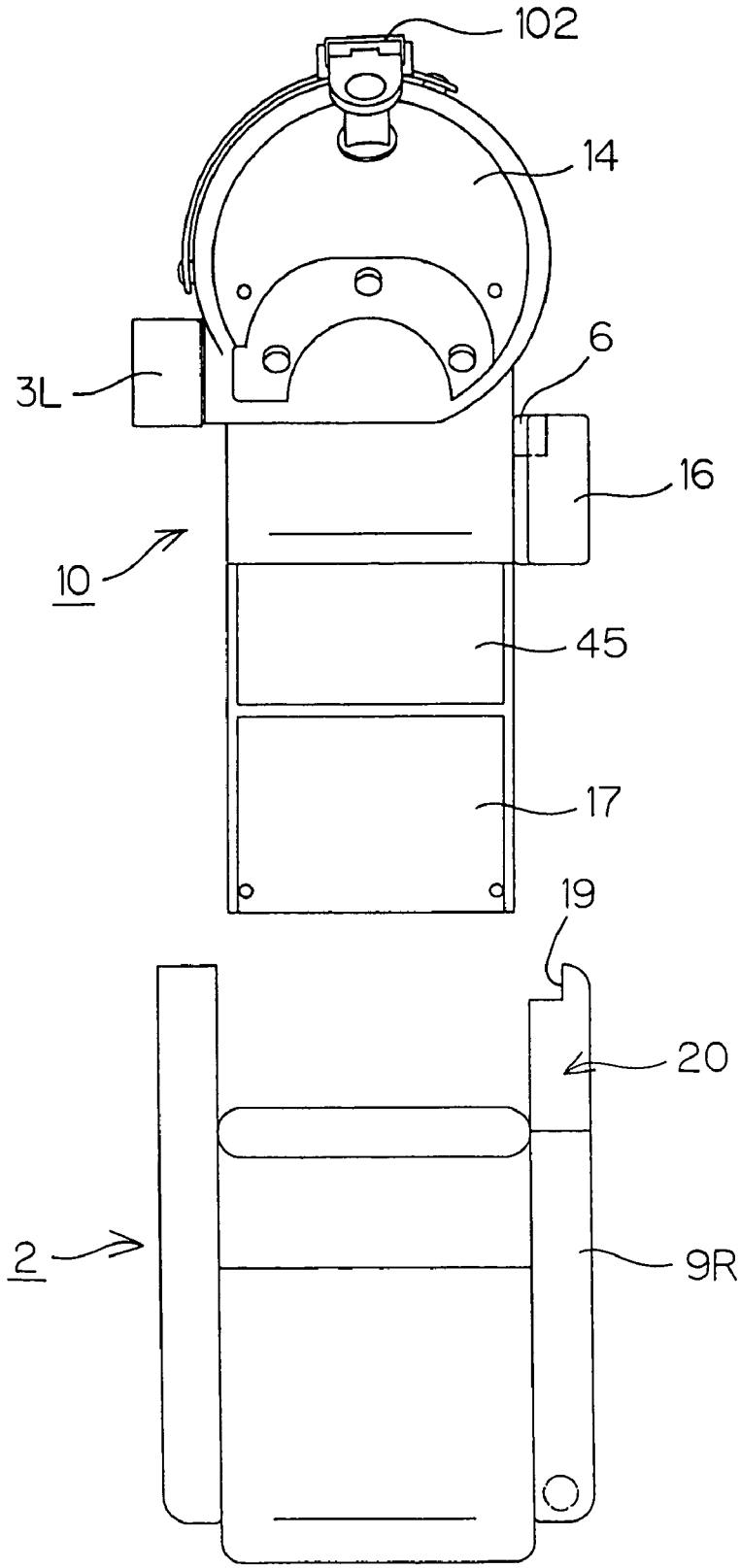
FIG. 5 is a plan view illustrating the automatic shampoo machine according to the embodiment of the invention with a seat and a main body thereof being separated.
Figure 6:
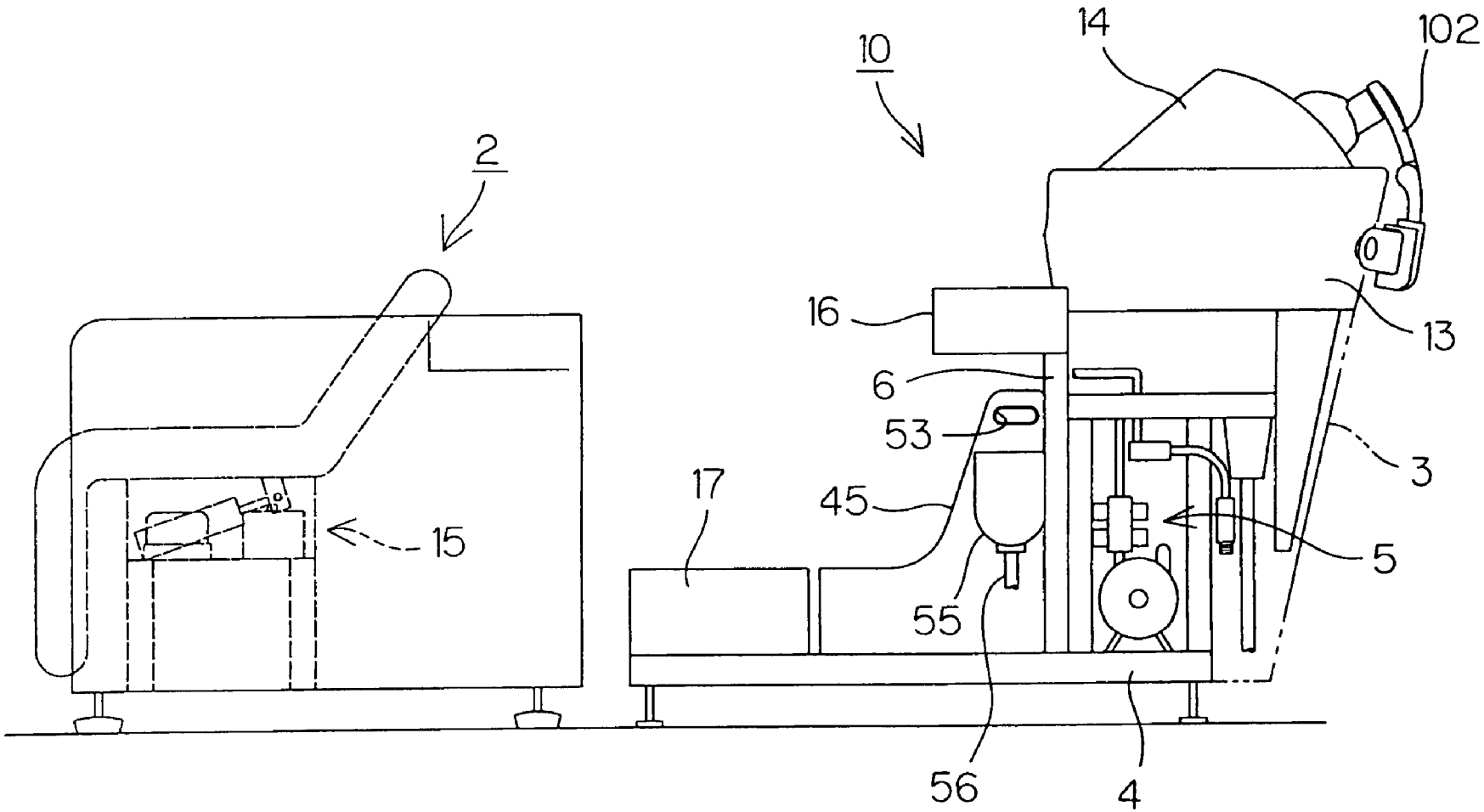
FIG. 6 is a side view illustrating the automatic shampoo machine according to the embodiment of the invention with the seat and the main body thereof being separated, wherein the internal constructions of the seat and the main body are illustrated by a broken line or a solid line.

In FIGS. 1 and 2, the automatic shampoo machine 1 is illustrated as being installed, for example, in a beauty salon for use, but is not necessarily provided in the state shown in FIGS. 1 and 2 when being shipped from a plant. If an attempt is made to transport the automatic shampoo machine with the seat 2, the housing 3 and the basin 13 combined together, the packing and transportation of the automatic shampoo machine are troublesome. In this embodiment, the seat 2 is separated from a main body including the housing 3 and the basin 13 as shown in FIGS. 5 and 6 when the machine is shipped from the plant. The seat 2 and the main body 10 are combined together at an installation site such as a beauty salon, when the automatic shampoo machine is installed.

FIGS. 5 and 6 are a plan view and a side view, respectively, illustrating the seat 2 and the main body 10 in the separated state. In FIG. 6, the internal constructions of the seat 2 and the main body 10 are illustrated by a broken line or a solid line.

Referring to FIGS. 5 and 6, the main body 10 includes abase frame 4. A mechanism 5 for the automatic shampooing operation is disposed in a rear upper portion of the base frame 4, and the basin 13 is disposed above the mechanism 5. The cone-shaped housing 3 tapered downward is disposed below the basin 13 to cover the base frame 4 and the mechanism 5.

A warm water reservoir tank 45 is mounted in a middle portion of the base frame 4 (in front of the mechanism 5). The warm water reservoir tank 45 is adapted to store warm water for the automatic shampooing operation to be described later, and configured so as not to interfere with the seat 2.

An electrical box 17 which contains electrical components for controlling the mechanism 5 is provided in a front portion of the base frame 4. Further, a support post 6 is provided upright on the base frame 4, and the operation panel 16 is supported on an upper end of the support post. Though not shown, the operation panel 16 is electrically connected to the electrical components in the electrical box 17.

Since the mechanism 5 and the electrical box 17 are respectively disposed in the rear and front portions of the base frame 4, the possibility that water is splashed over the electrical box 17 is extremely reduced and the short circuit and electric leakage of the electrical components are prevented.

A reclining mechanism 15 is incorporated in the seat 2. As shown in FIG. 5, the left arm-rest 9R of the seat 2 has a cut-away portion 19 provided in a rear end portion thereof as having a hook-like shape as seen in plan. Further, the rear upper side portion of the arm-rest 9R is beveled as having an oblique surface 20. When the main body 10 and the seat 2 are combined together, the support post 6 supporting the operation panel 16 is fitted in the cut-away portion 19, and the operation panel 16 is fitted along-the oblique surface 20. That is, the operation panel 16 looks as if it was attached to the rear upper portion of the left arm-rest 9R when the main body 10 and the seat 2 are combined together, but is actually mounted on the main body 10.

This arrangement saves labor for connecting electrical components in the main body 10 with electrical components in the seat 2 by connectors and the like when the main body 10 and the seat 2 are combined together at the installation site.

Where the reclining mechanism for the seat 2 is adapted to be electrically driven by operating the operation panel 16, the reclining mechanism should be electrically connected to the electrical box 17 in the main body 10. However, where the reclining mechanism for the seat 2 is adapted to be hydraulically driven and operable on the side of the seat 2, the electrical interconnection between the main body 10 and the seat 2 can completely be eliminated.

Figure 7:
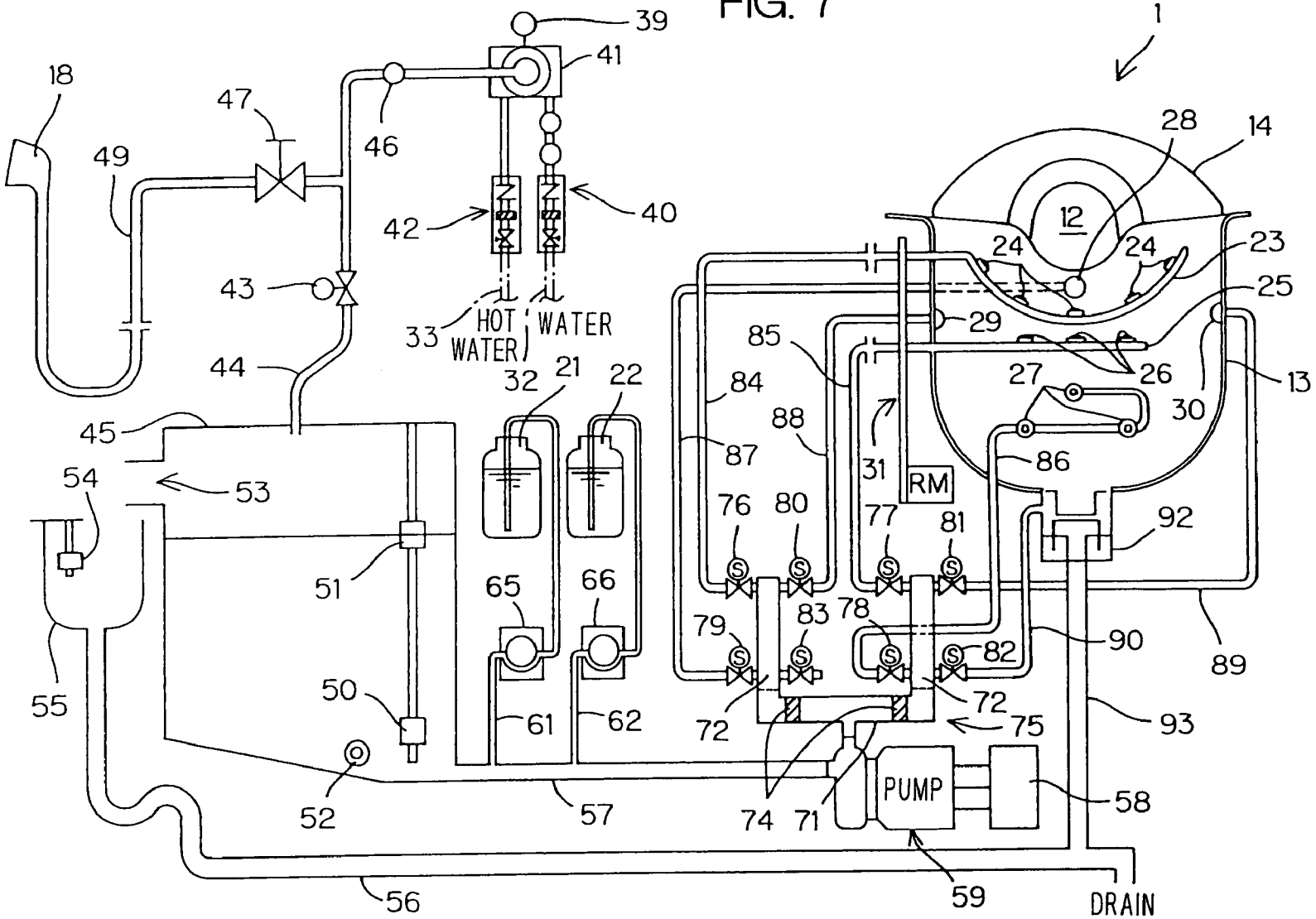
FIG. 7 is a channel diagram of the automatic shampoo machine according to the embodiment of the invention.

FIG. 7 is a channel diagram of the automatic shampoo machine 1. Referring to FIG. 7, a plurality of nozzles 24, 26, 27 to 30 for spouting warm water are provided in the basin 13. The nozzles 24 are upper nozzles which are disposed on an upper nozzle link 23. The nozzles 26 are lower nozzles which are disposed on a lower nozzle link 25. The nozzles 27 to 30 are fixed nozzles.

The upper nozzle link 23 is located in an upper portion of the basin 13, and has a generally semicircular shape so as to surround the person's head. The upper nozzle link 23 is pivotally attached at its end to the peripheral wall of the basin 13 so as to be swung between positions diagonally above and below the person's head. The aforesaid plural upper nozzles 24 are arranged along the upper nozzle link 23 and oriented toward the head. The head and the proximal portions of hair can be washed by warm water spouted from the upper nozzles 24, and the head skin can be massaged by the spouted warm water.

The lower nozzle link 25 has a rod shape, and is located below the person's head in the basin 13. The lower nozzle link 25 is supported at its end on the peripheral wall of the basin 13. The aforesaid plural lower nozzles 26 are arranged along the lower nozzle link 25 and oriented toward the head. The proximal portions of the hair and the nape can be washed by warm water spouted from the lower nozzles 26.

A plurality of fixed nozzles 27, e.g., three fixed nozzles, are provided on relatively lower front and rear portions of the interior wall of the basin 13 mainly for washing distal portions of long hair. These fixed nozzles 27 are connected to a single pipe 86 and adapted to spout warm water supplied from the pipe 86.

On the other hand, the fixed nozzles 28, 29, 30 are provided on a relatively upper portion of the interior wall of the basin 13 mainly for massaging the head skin by the spouted warm water. The fixed nozzles 28, 29 and 30 are respectively connected to pipes 87, 88 and 89.

The directions of the warm water spouted from the respective fixed nozzles 27 to 30 can be adjusted by changing the spout directions of the fixed nozzles 27 to 30.

Since the upper nozzles 24 and the lower nozzles 26 are respectively provided on the upper nozzle link 23 and the lower nozzle link 25 in this embodiment, the person's head and nape can advantageously be cleaned.

However, all the nozzles may be provided on the interior wall of the basin 13 without the provision of the pivotal nozzle links in another arrangement.

Next, an explanation will be given to water channels for supplying warm water to the respective nozzles.

Warm water for the shampooing is supplied into the automatic shampoo machine 1 from an external tap water supply and a boiler. Water supplied from a water supply pipe 32 connected to the tap water supply is applied to a mixing valve 41 via a water supply portion 40. The water supply portion 40 is a unit including a manually operable valve, a filter, a check valve, an accumulator, a safety valve and the like. Hot water supplied through a hot water supply pipe 33 from the boiler is applied to the mixing valve 41 via a hot water supply portion 42. The hot water supply portion 42 is a unit including a manually operable valve, a filter, a check valve and the like. In the mixing valve 41, the applied water and hot water are mixed together to prepare warm water having a proper temperature. The mixing valve 41 is driven by a motor 39. The temperature of the warm water prepared by the mixing valve 41 is adjustable by operating the operation panel 16 by the operator.

The warm water prepared by the mixing valve 41 is introduced into a hand shower 18 via a supply hose 49 when a shower valve 47 is opened. As a result, the warm water can be spouted from the hand shower 18.

The warm water prepared by the mixing valve 41 is also supplied to the warm water reservoir tank 45 via a supply pipe 44 when a warm water supply valve 43 is opened. The supply pipe 44 is provided with a thermistor 46 for detecting the temperature of the warm water supplied from the mixing valve 41.

A lower water amount sensor 50 and an upper water amount sensor 51 for detecting the amount of warm water stored in the warm water reservoir tank 45 are provided in the warm water reservoir tank 45. Outputs of the lower water amount sensor 50 and the upper water amount sensor 51 are utilized for the open/close control of the warm water supply valve 43 by a microprocessor (not shown). Thus, the warm water reservoir tank 45 is automatically constantly filled with a proper amount of warm water.

A thermistor 52 for detecting the temperature of the warm water stored in the warm water reservoir tank 45 is provided at a lower position in the warm water reservoir tank 45.

An overflow port 53 for causing excess warm water to overflow out of the warm water reservoir tank 45 when the warm water is stored in an amount greater than the detection limit of the upper water amount sensor 51 is provided at an upper position of the warm water reservoir tank 45. A drain pan 55 is provided below the overflow port 53. The warm water overflowing from the overflow port 53 is received in the drain pan 55, and drained out of the machine through a drain pipe 56 extending from the drain pan 55 to the outside of the machine.

A water level sensor 54 is provided in the drain pan 55. The water level sensor is adapted to detect abnormal fill-up of the drain pan 55 which may occur when warm water once drained through the drain pipe 56 flows back into the drain pan.

The overflow port 53 of the warm water reservoir tank 45 and the drain pan 55 are located in the rear portion of the main body 10 as shown in FIG. 6. Thus, water overflowing from the overflow port 53 is prevented from splashing over the electrical box 17.

Referring again to FIG. 7, an outlet pipe 57 is connected to a lower portion of the warm water reservoir tank 45. The other end of the outlet pipe 57 is connected to a suction port of a pump 59. The pump 59 is driven by application of an AC current from an inverter 58. When the pump 59 is driven, the warm water stored in the warm water reservoir tank 45 is sucked into the pump 59 through the outlet pipe 57.

A shampoo liquid supply pipe 61 and a treatment liquid supply pipe 62 are joined to the midst of the outlet pipe 57. The shampoo liquid supply pipe 61 connects a shampoo liquid container 21 to the outlet pipe 57 via a shampoo liquid pump 65. The treatment liquid supply pipe 62 connects a treatment liquid container 22 to the outlet pipe 57 via a treatment liquid pump 66. A shampoo liquid is stored in the shampoo liquid container 21, and a treatment liquid is stored in the treatment liquid container 22. These containers 21, 22 are removably disposed in the housing as will be described later.

The shampoo liquid pump 65 and the treatment liquid pump 66 are respectively adapted to pump up the shampoo liquid and the treatment liquid stored in the shampoo liquid container 21 and the treatment liquid container 22 by squeezing the pipes 61 and 62 to feed out the shampoo liquid and the treatment liquid to the outlet pipe 57.

With this arrangement, the shampoo liquid stored in the shampoo liquid container 21 is supplied into the outlet pipe 57 via the shampoo liquid supply pipe 61 by driving the shampoo liquid pump 65 when the pump 59 is driven by the inverter 58. As a result, the shampoo liquid is mixed with the warm water for preparation of warm shampoo water.

Similarly, the treatment liquid stored in the treatment liquid container 22 is supplied into the outlet pipe 57 via the treatment liquid supply pipe 62 by driving the treatment liquid pump 66 when the pump 59 is driven. As a result, the treatment liquid is mixed with the warm water for preparation of warm treatment water.

The warm water, the warm shampoo water or the warm treatment water sucked into the pump 59 is discharged from an outlet of the pump 59. The outlet of the pump 59 is connected to a branch pipe 75 which is branched into a plurality of branches, e.g., eight branches.

The branch pipe 75 is provided with filters 74. Eight valves, i.e., an upper nozzle valve 76, a lower nozzle valve 77, fixed nozzle valves 78 to 81, a drain valve 82 and a spare valve 83 are connected to distal ends of the respective branches disposed downstream of the filters. The spare valve 83 may be dispensed with. Pipes 84 to 90 are respectively connected to the valves 76 to 82 except the spare valve 83.

A distal end of the pipe 84 is connected to the upper nozzle link 23. A distal end of the pipe 85 is connected to the lower nozzle link 25. A distal portion of the pipe 86 is disposed outwardly of the peripheral wall of the basin 13, and the aforesaid plural fixed nozzles 27 are arranged at predetermined intervals along the distal portion of the pipe 86. Distal ends of the pipes 87 to 89 are respectively connected to the fixed nozzles 28 to 30 provided on the interior wall of the basin 13. A distal end of the pipe 90 is connected to the drain pipe 56 via a drain trap 92 and a drain pipe 93 connected to a bottom lower portion of the basin 13.

With this arrangement, the warm water, the warm shampoo water or the warm treatment water is spouted from desired ones of the nozzles in the basin 13 by driving the pump 59 by the inverter 58 and selectively opening the valves 76 to 81 as required for automatically shampooing the person's hair.

The upper nozzle link 23 is swung and the lower nozzle link 25 is pivoted by a driving mechanism 31 during the shampooing operation. As a result, the spouting directions of the warm water spouted from the upper nozzles 24 and the lower nozzles 26 are varied, whereby the person's hair can uniformly and properly be shampooed.

Where the automatic shampoo machine is employed, the operator may manually perform a finish rinsing operation on the person after the automatic shampooing operation. Further, the operator may perform a hair dyeing operation on the person after the automatic shampooing operation. In addition, the operator wipes wet hair with a towel after the automatic shampooing operation.

Figure 8:
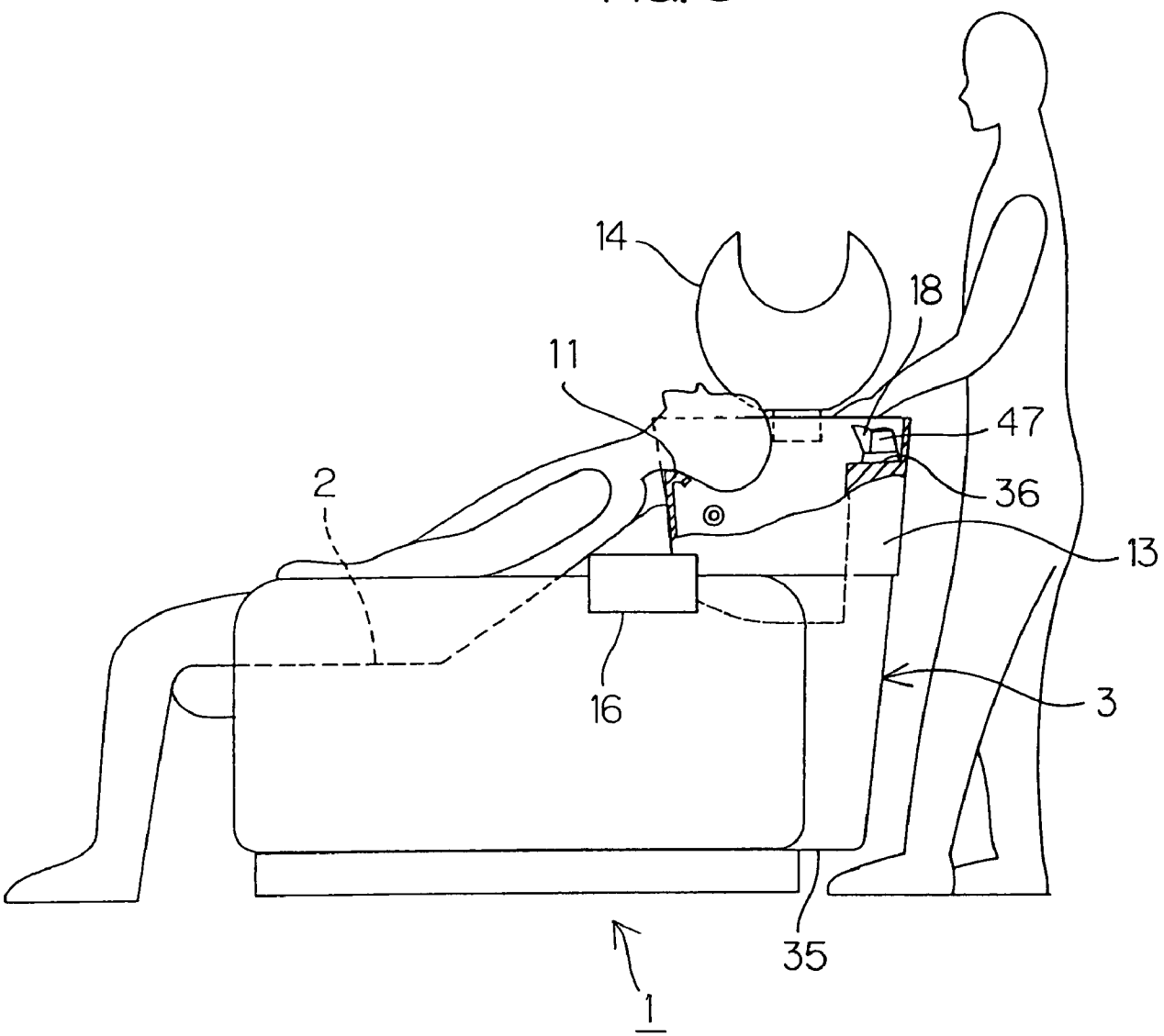
FIG. 8 is a side view illustrating the automatic shampoo machine according to the embodiment of the invention in a state where an operator performs an operation from the rear side of a basin.

The following considerations are given to the automatic shampoo machine 1 according to this embodiment so as to permit the operator to perform the aforesaid various operations, treatments and tasks from the rear side of the basin 13 as shown in FIG. 8.

These considerations are as follows:

(1) the operation panel 16 is disposed in the vicinity of the basin 13 at a position which ensures easy operation by the operator;

(2) the shampoo liquid container 21 and the treatment liquid container 22 are disposed at a position which is out of the way of the operator's tasks and ensures easy replacement and replenishment of the shampoo liquid container 21 and the treatment liquid container 22;

(3) the hood 14 is movable to a position out of the way of the operator's operations and tasks when the hood 14 is opened; and (4) the periphery, particularly the lower peripheral portion, of the basin 13 is configured so as not to cause any inconvenience to the operator's operations and tasks.

Since the consideration (1) has already been described, the consideration (2) and the considerations subsequent thereto will hereinafter be described more specifically.

Figure 9:
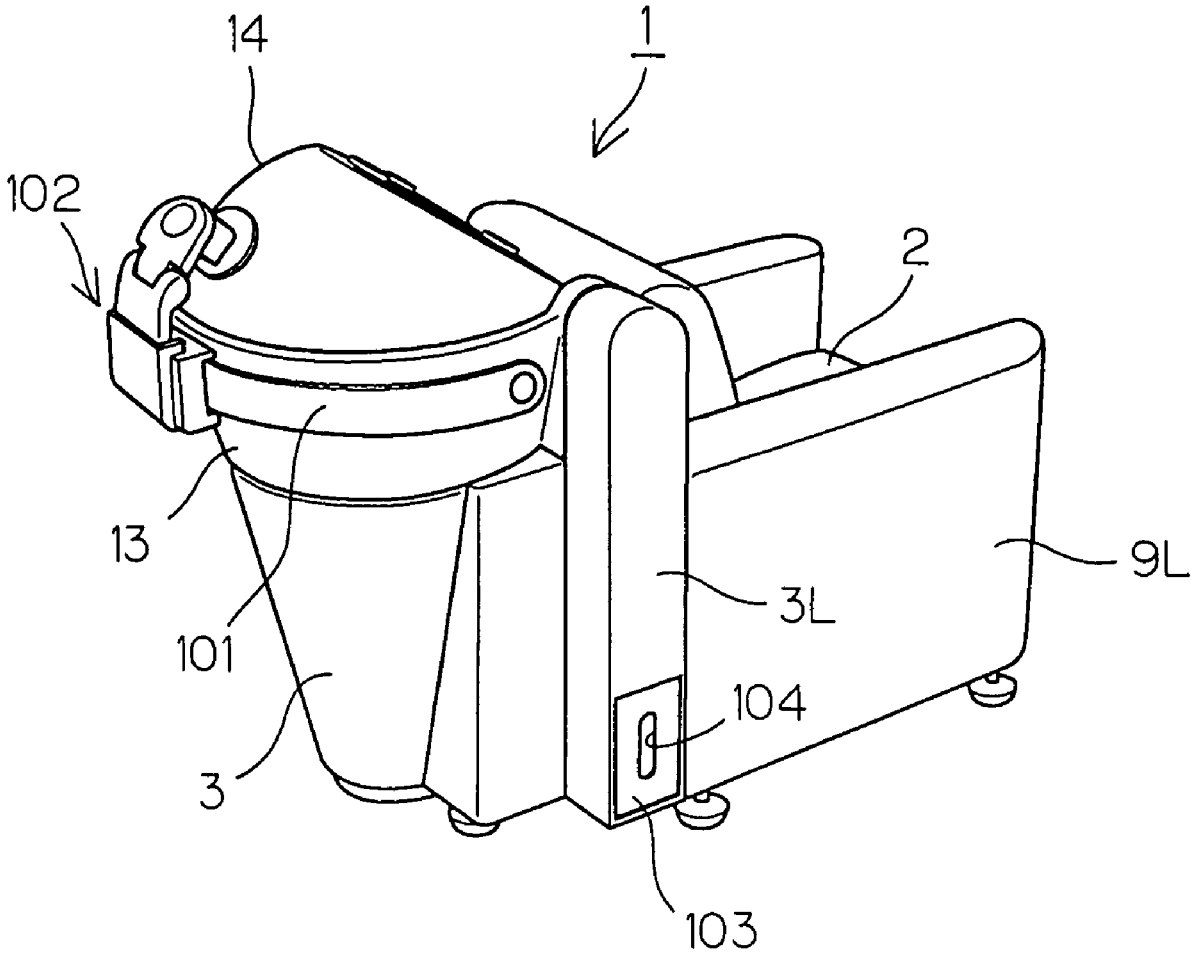
FIG. 9 is a perspective view illustrating the automatic shampoo machine according to the embodiment of the invention as seen from a rear upper left side.

FIG. 9 is a perspective view illustrating the automatic shampoo machine 1 as seen from a rear left side. A guide rail 101 is provided on the outer periphery of the basin 13 as circumferentially extending. The open/close unit 102 is attached to the guide rail 101. An upper portion of the open/close unit 102 is coupled to a rear surface of the hood 14 for openably holding the hood 14. With the hood 14 being lifted upright, the open/close unit 102 is movable rightward along the guide rail 101 (rightward in FIG. 9, and leftward along the periphery of the basin 13 as seen from the front side of the automatic shampoo machine 1).

The peripheral surface of the basin 13 is continuous to the cone-shaped housing 3 located below the basin, and has an outer diameter increasing upward.

A rectangular column-shaped housing 3L is disposed just behind an arm-rest 9L on the left side of the basin 13 (on the left side as seen from the front side of the automatic shampoo machine 1). The driving mechanism 31 described with reference to FIG. 7 is disposed in the housing 3L. The housing 3L has a free space provided in a lower portion thereof, and this free space is utilized for the provision of the shampoo liquid container 21 and the treatment liquid container 22. More specifically, a cover 103 is provided on a lower side face of the housing 3L, and has a window 104 for checking the residual amounts of the liquids in the shampoo liquid container 21 and the treatment liquid container 22 disposed in the housing 3L.

Since the driving mechanism 31 is provided, the free space provided in the lower portion of the housing 3L covering the driving mechanism 31 is utilized for the provision of the shampoo liquid container 21 and the treatment liquid container 22 in this embodiment. However, the shampoo liquid container 21 and the treatment liquid container 22 may be disposed at any position which is out of the way of the operator when the operator operates the automatic shampoo machine 1. That is, the hood 14 is moved to the position out of the way of the operator when the hood 14 is open. Therefore, a position below the hood 14 is the position out of the way of the operator. Hence, the shampoo liquid container 21 and the treatment liquid container 22 may be disposed in a region which is located below the hood 14 when the hood 14 is opened and moved to the predetermined position.

Figure 10:
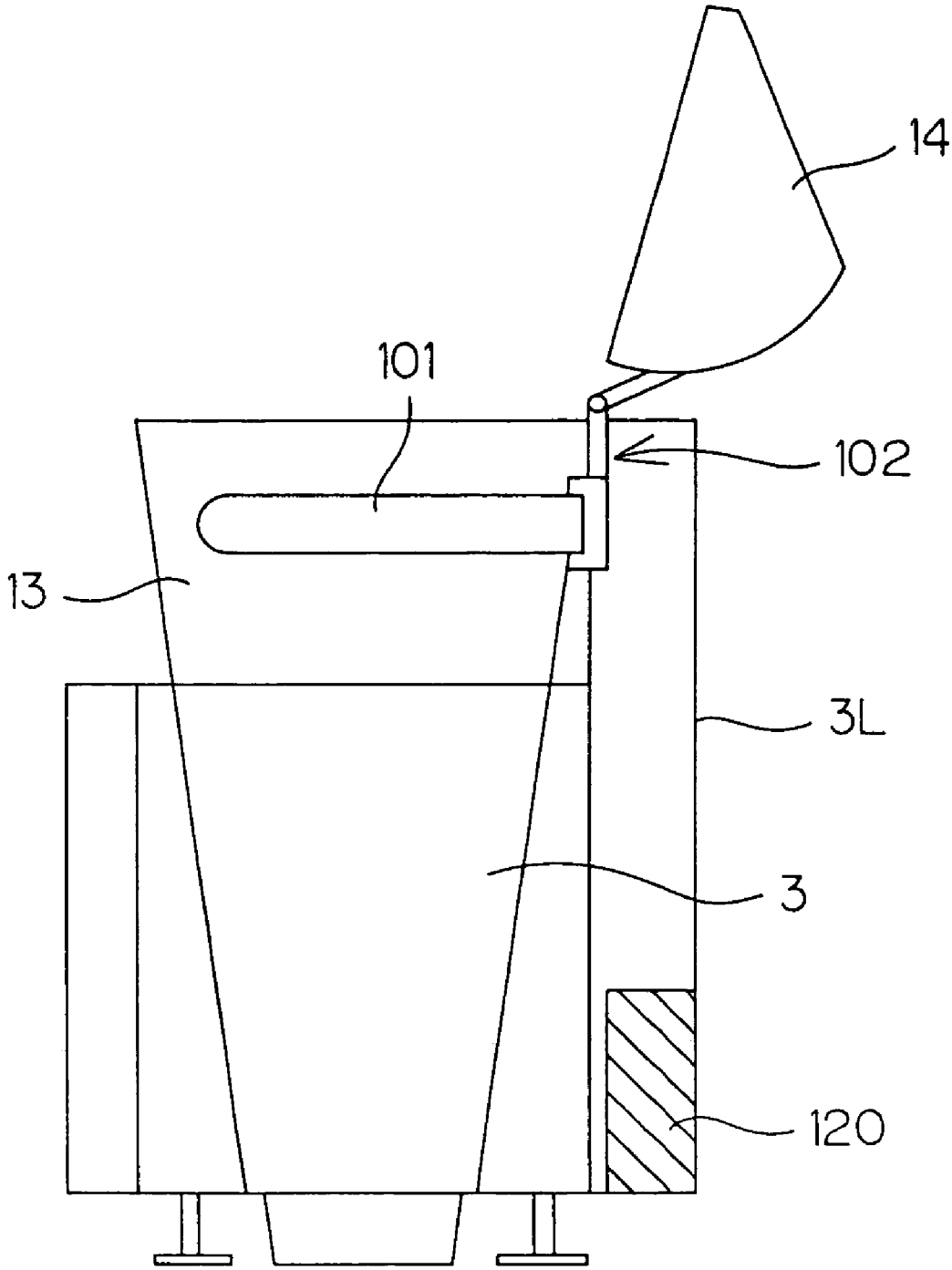
FIG. 10 is a diagram illustrating the automatic shampoo machine according to the embodiment of the invention as seen from the rear side for explaining the positions of a shampoo liquid container and a treatment liquid container accommodated therein.

FIG. 10 is a diagram illustrating the automatic shampoo machine 1 as seen from the rear side, wherein the shampoo liquid container 21 and the treatment liquid container 22 are accommodated in a hatched housing portion 120 in the housing 3L.

Figure 11:
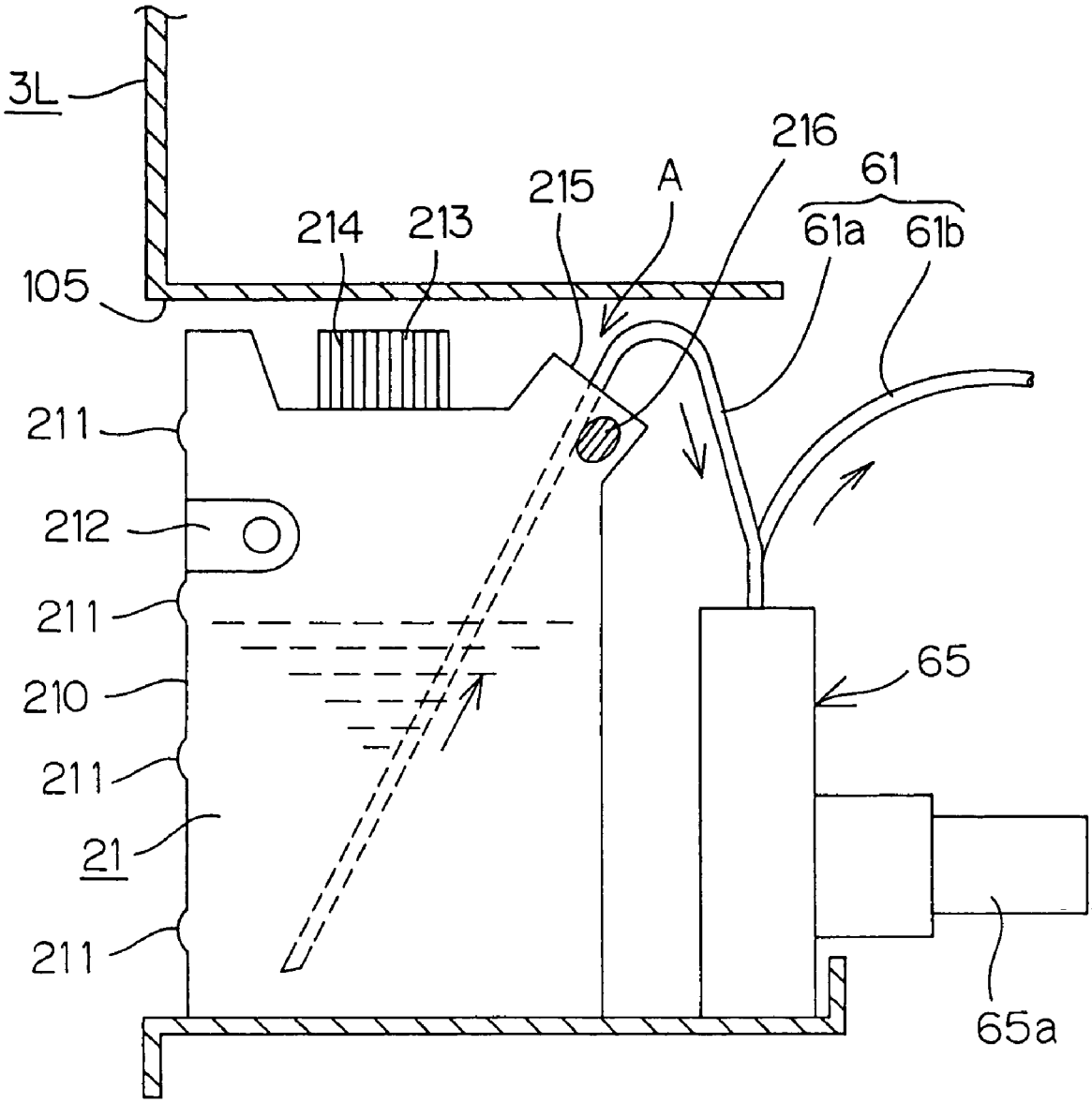
FIG. 11 is a schematic diagram illustrating the detailed construction of a housing portion in which the shampoo liquid container and the treatment liquid container are accommodated.

FIG. 11 is a schematic diagram illustrating the detailed construction of the housing portion, as seen from the front side of the automatic shampoo machine 1, in which the shampoo liquid container 21 and the treatment liquid container 22 are accommodated.

In FIG. 11, a reference numeral 65 denotes the shampoo liquid pump. The shampoo liquid pump 65 is driven by a dedicated motor 65*a*. As described with reference to FIG. 7, the shampoo liquid pump 65 is adapted to squeeze the shampoo liquid supply pipe 61 to pump up the shampoo liquid stored in the shampoo liquid container 21. A distal portion of the shampoo liquid supply pipe 61 on a suction side 61*a* is inserted in the shampoo liquid container 21. The shampoo liquid supply pipe extends through the shampoo liquid pump 65 to a discharge side 61*b*, and is joined to the outlet pipe 57 (not shown in FIG. 11).

Figure 13:
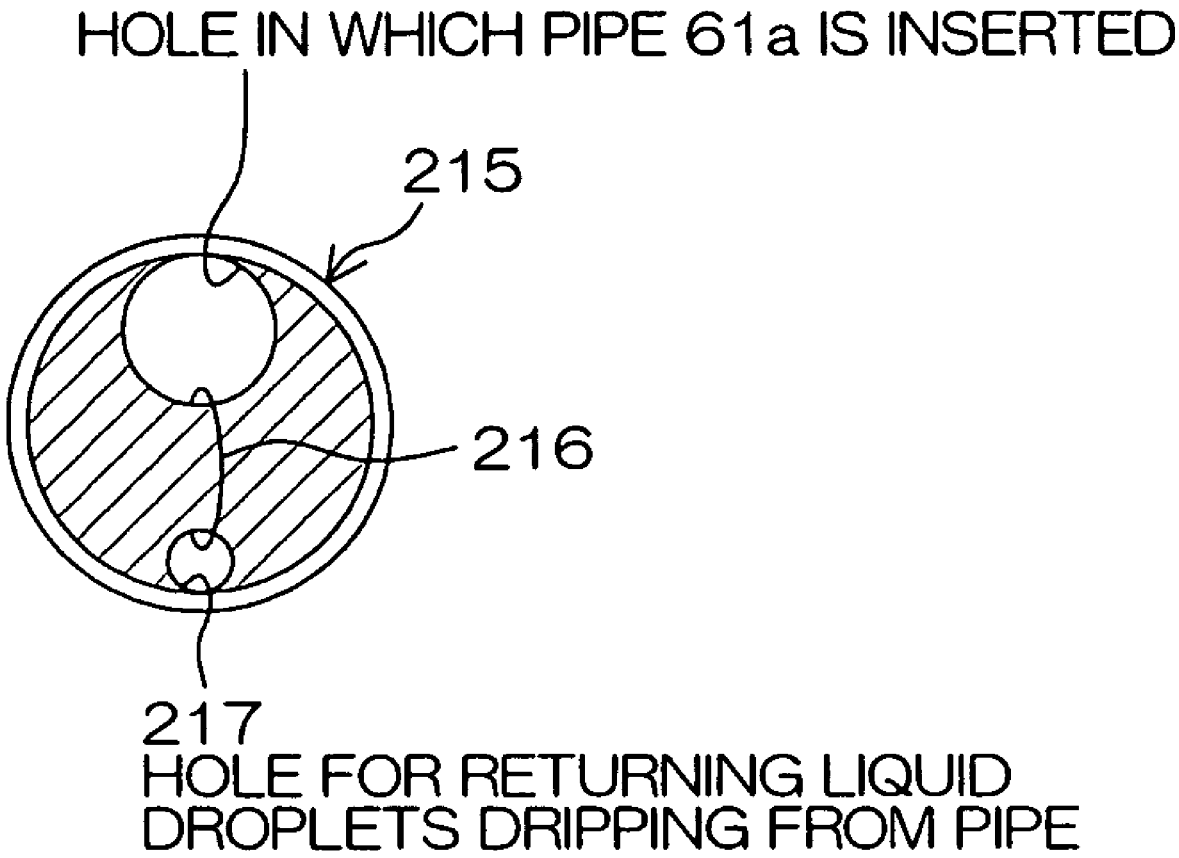
FIG. 13 is a diagram illustrating the internal construction of a pump-up port of the container as seen in an arrow direction A in FIG. 11.

The shampoo liquid container 21 has residual amount marks 211 vertically arranged at predetermined intervals on one side face 210 thereof (a side face exposed to an opening 105 provided on the housing 3L for loading and unloading of the container). The residual amount marks 211 are desirably provided in the form of projections, linear projections or linear recesses provided on the one side face 210 of the shampoo liquid container 21. The shampoo liquid container 21 further has indentations 212 provided on front and rear faces thereof, so that the shampoo liquid container 21 can be held by two fingers to be taken out from the side of the one side face 210. The shampoo liquid container 21 has a replenishment opening 213 provided on an upper face thereof and closed with a cap 214. Further, the shampoo liquid container 21 has a pump-up port 215 provided on an upper right face thereof. The pump-up port 215 extends diagonally upward from the container 21, and has a liquid drip prevention rib 216 provided therein as extending across the pump-up port 215 transversely of the pump-up port 215. FIG. 13 is a diagram illustrating the pump-up port 215 as seen in an arrow direction A in FIG. 11.

Figure 12:
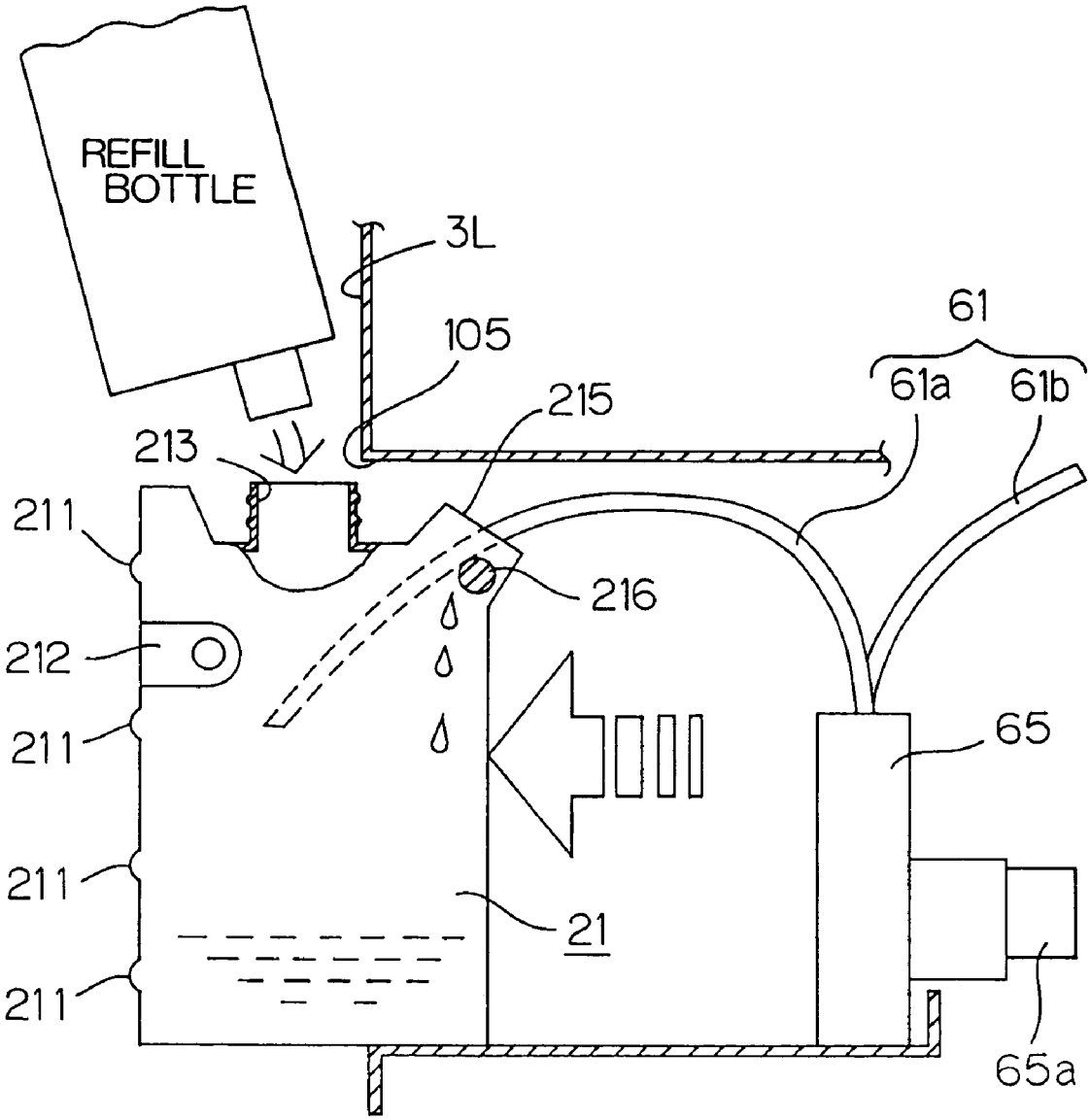
FIG. 12 is a schematic diagram illustrating the detailed construction of the housing portion in which the shampoo liquid container and the treatment liquid container are accommodated.

When only a small amount of the shampoo liquid remains in the shampoo liquid container 21, the shampoo liquid container 21 is held by fitting fingers in the indentations 212 so as to be taken out of the opening 105 as shown in FIG. 12. Then, the cap 214 is removed, and the shampoo liquid container is replenished with the shampoo liquid from the replenishment opening 213. At this time, the suction pipe 61*a* of the shampoo liquid supply pipe 61 which has been inserted in the shampoo liquid container 21 is exposed from the pump-up port 215. The generally viscous shampoo liquid adhering on the outer periphery of the pipe 61*a* is liable to drip from the pipe 61*a*. The rib 216 is provided for the prevention of the dripping of the liquid. By taking out the shampoo liquid container 21, the pipe 61*a* is exposed from the pump-up port 215. At this time, a lower portion of the outer periphery of the pipe 61*a* being taken out is kept in sliding contact with the rib 216. Thus, the shampoo liquid adhering on the outer periphery of the pipe 61*a* is scraped off by the rib 216, so that the dripping of the shampoo liquid from the exposed pipe 61*a* can be prevented. The shampoo liquid scraped off by the rib 216 returns into the shampoo liquid container 21 through a hole 217 provided below the rib 216.

The treatment liquid container 22 is disposed in juxtaposition with the shampoo liquid container 21, and has substantially the same construction.

Figure 14:
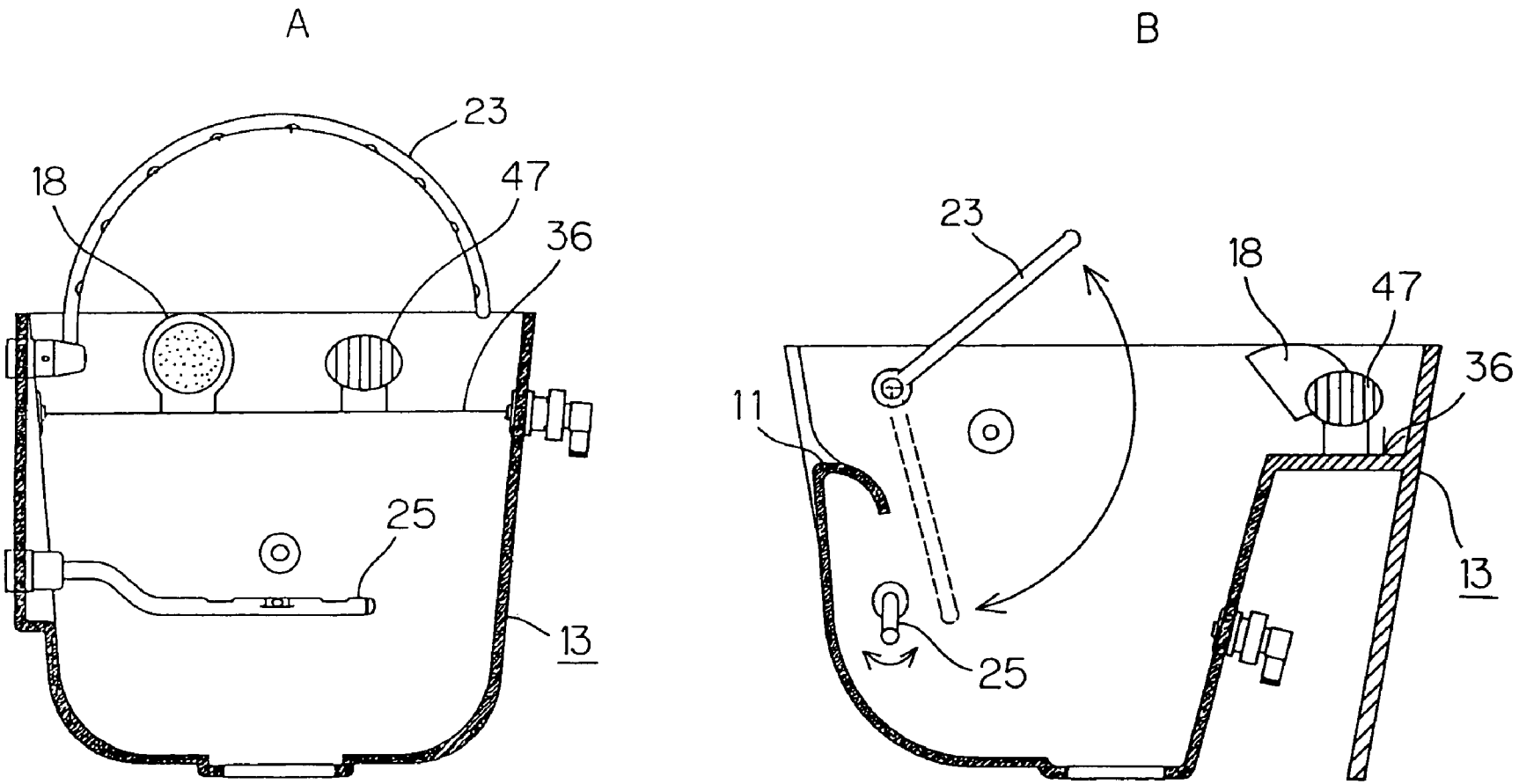
FIG. 14 are diagrams for explaining the construction of the basin according to the embodiment of the invention.

FIGS. 14 are diagrams for explaining the construction of the basin 13. FIG. 14A is a sectional view as seen from the front side, and FIG. 14B is a sectional view as seen from the right side. The basin 13 is an integrally formed ceramic basin in this embodiment. The basin 13 has an indentation provided as the neck portion 11 on a generally middle portion of a front upper edge of the basin 13 for receiving the neck of the person assuming a supine attitude. The basin 13 has a flat surface 36 provided on a rear wall thereof as extending generally horizontally rearward.

The hand shower 18 to be used when the operator manually performs an auxiliary shampooing operation and the like and the shower valve 47 for adjusting the amount of the warm water spouted from the hand shower 18 are arranged in juxtaposition on the flat surface 36. The flat surface 36 is located at a level lower than an upper peripheral edge of the basin 13, so that the hand shower 18 and the shower valve 47 disposed on this flat surface are hidden within the hood 14 when the hood 14 not shown is closed.

The hand shower 18 can be pulled out by a hand.

As compared with a basin such as composed of an FRP (fiber reinforced plastic), the ceramic basin 13 in this embodiment has an improved chemical resistance, and a dye such as a hair dye is less liable to adhere on the basin. Further, water splashing noises caused by the warm water spouted in the basin 13 are not echoed on the interior wall of the basin, and noises caused during the automatic shampooing operation and the auxiliary shampooing operation employing the hand shower are mitigated. Further, the driving noises of the motors and the pumps disposed below the basin 13 are less liable to be conducted upward above the basin 13. Therefore, the automatic shampoo machine is quiet for the person being shampooed.

Further, the neck portion 11 is configured so that an upper front edge portion of the basin 13 is curved inward to be folded (into a so-called undercut shape). The neck portion 11 extends inwardly of the basin 13 and, therefore, has an anteroposterior width sufficient to receive the person's neck. The lower nozzle link 25 is disposed within a space between the interior surface of the basin 13 and the neck portion 11 folded downward thereby to be neatly hidden.

Further, the ceramic basin 13 may have an upper edge smoothly finished and interior and exterior surfaces smoothly baked with glazing or the like. Therefore, the ceramic basin 13 per se may have a decorative surface without provision of a separate decorative component around the basin 13.

Figure 15:
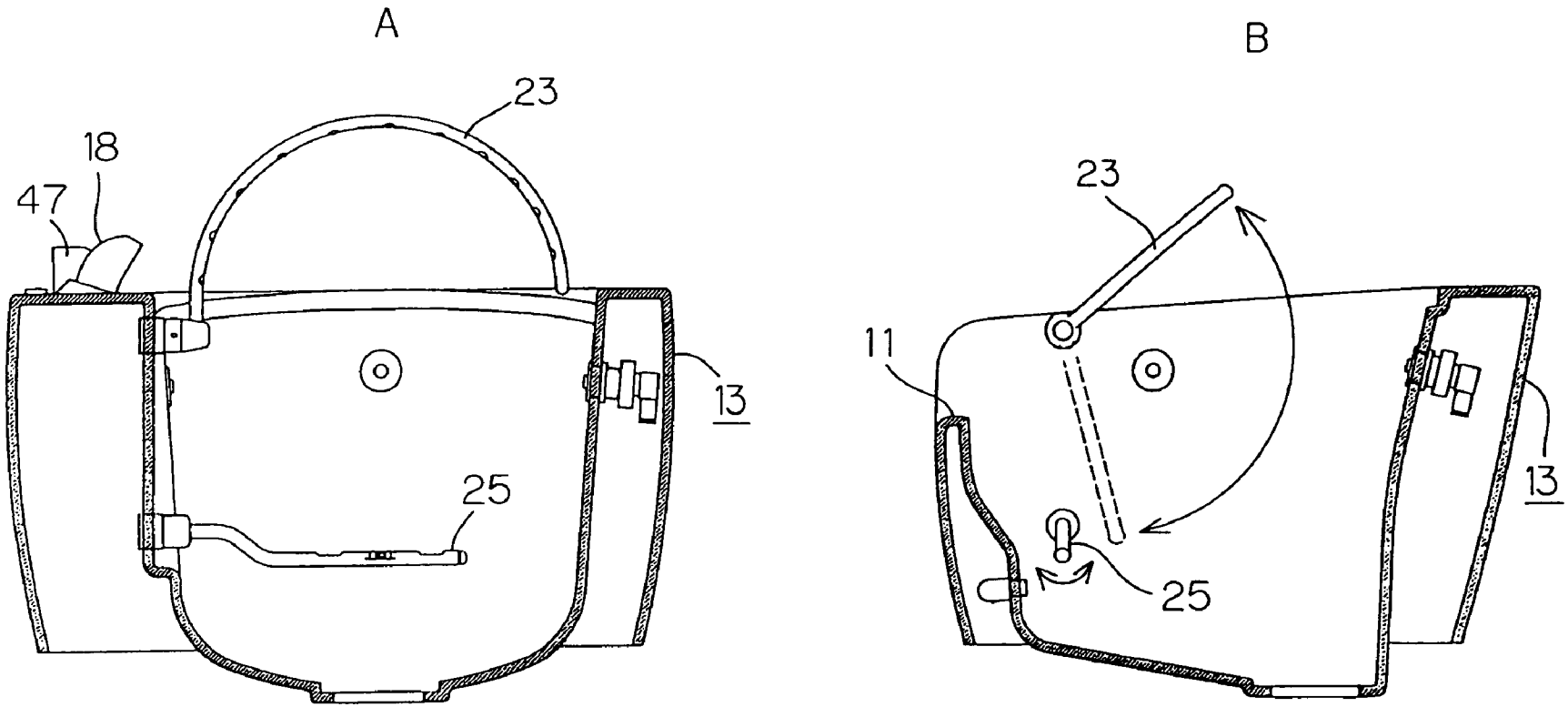
FIG. 15 are diagrams illustrating another exemplary shape of the basin.

The shape of the basin 13 is not limited to that shown in FIGS. 14, but the basin may have a shape as shown in FIGS. 15A and 15B.

Where the basin 13 has the shape shown in FIG. 15, the exterior of the basin 13 can be exposed as it is. The hand shower 18 and the shower valve 47 may be disposed, for example, on a lateral side of the basin 13 rather than on the rear upper surface of the basin.

Next, an explanation will be given to an arrangement for the opening/closing and movement of the hood 14.

The hood 14 is adapted to cover and uncover the top of the basin 13 with the person's face being exposed from the hood. The hood 14 has an upwardly convex shape when being closed, and the opening 12 is provided on a front oblique surface 20 of the hood. A generally U-shaped flexible seal member is provided around the opening 12. The seal member is referred to as "face seal", which is fitted along the person's face to seal the periphery of the person's face.

Figure 16:
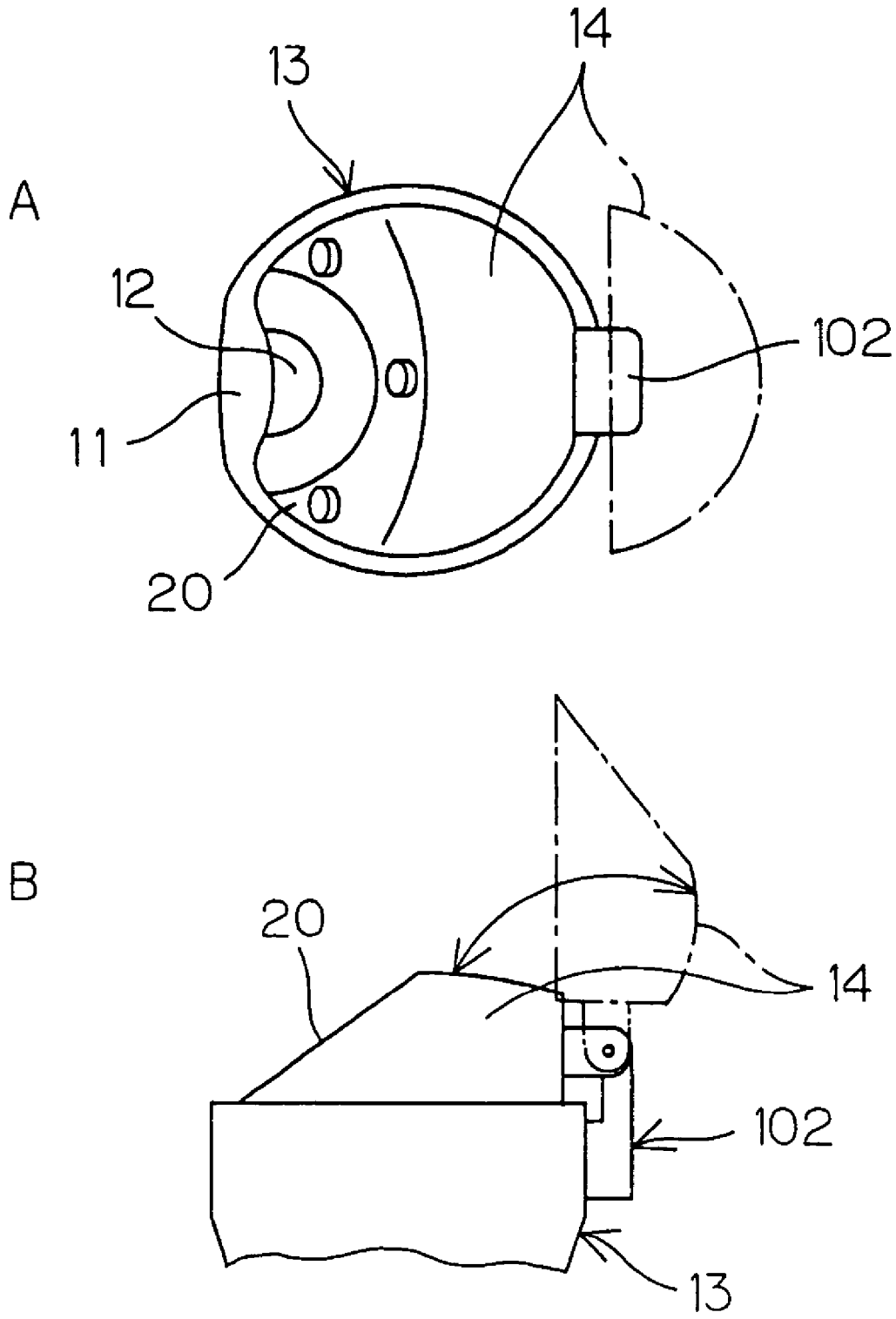
FIG. 16 are diagrams illustrating a hood in a closed state for explaining an arrangement for opening/closing and movement of the hood.
Figure 17:
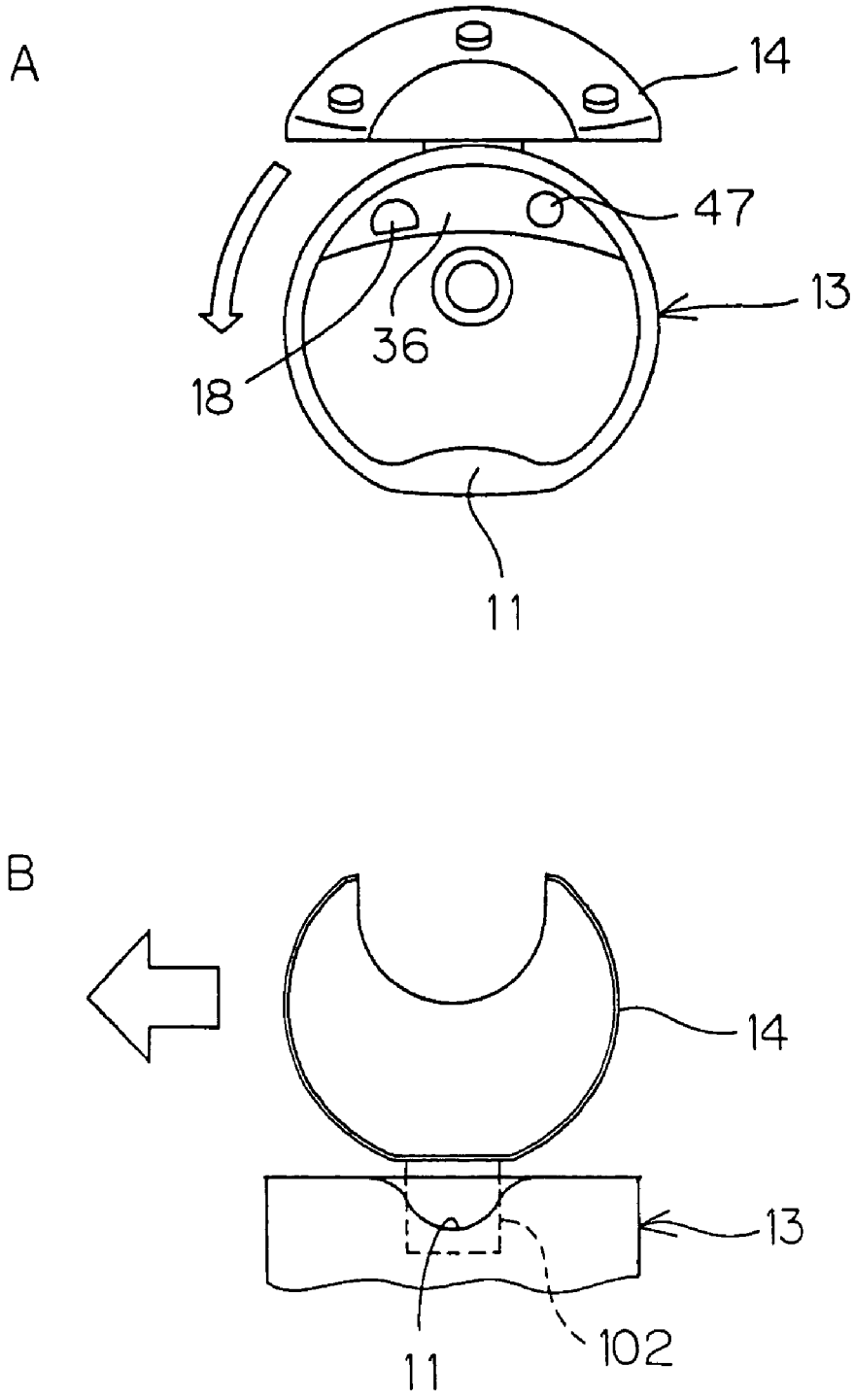
FIG. 17 are diagrams illustrating the hood in an open state for explaining the arrangement for the opening/closing and movement of the hood.

The open/close unit 102 connected to the rear portion of the hood 14 is adapted to limit the position of the hood 14 to hold the hood 14 at a hood closing position as shown in FIGS. 16 and at a hood opening position as shown in FIGS. 17. At the closing position, the hood 14 covers the top of the basin 13. At the opening position, the hood uncovers the top of the basin 13, and is movable along the periphery of the basin 13, as indicated by an arrow, from a first position shown in FIG. 17A to a second position angularly spaced about 90 degrees from the first position.

Figure 18:
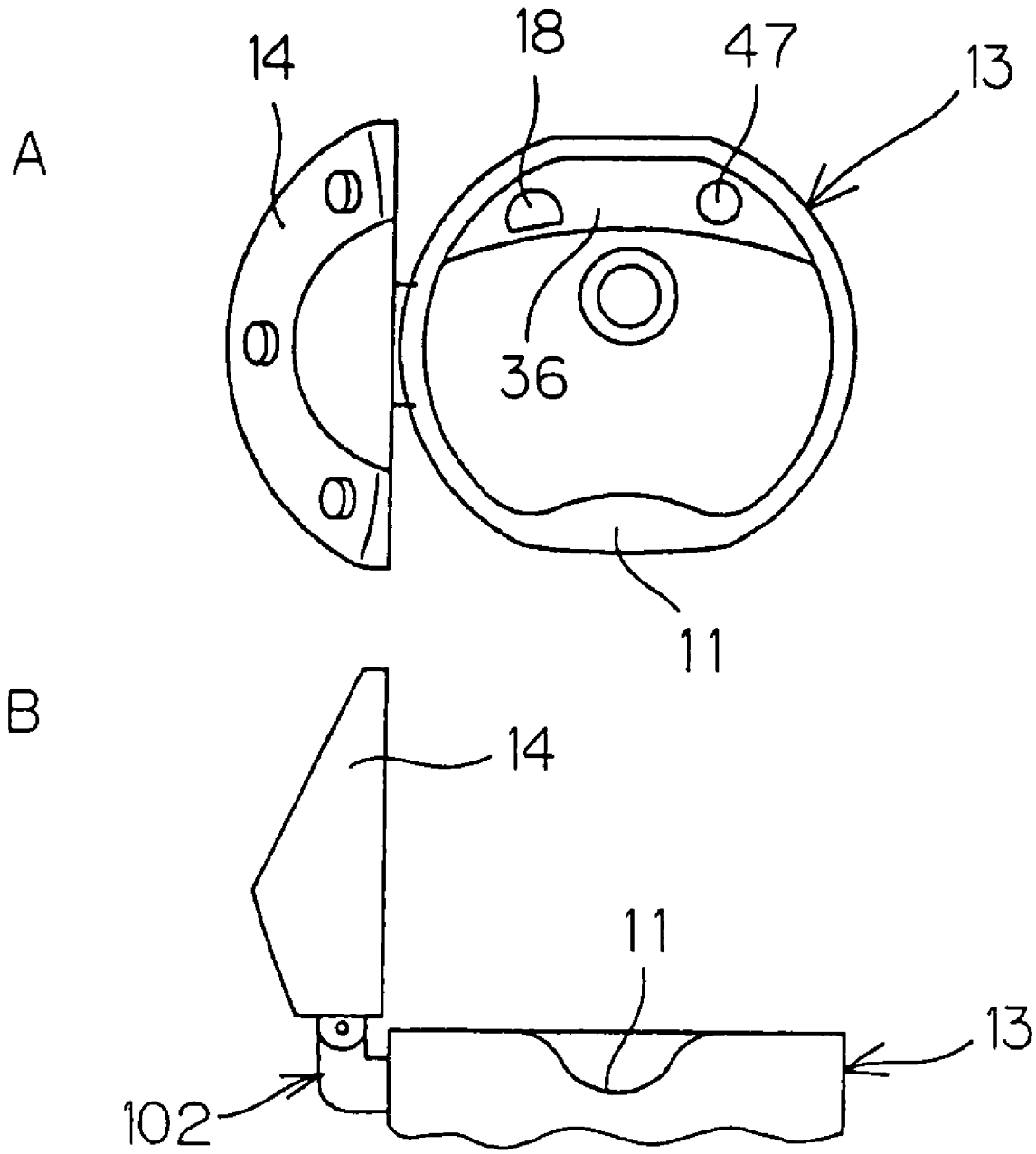
FIG. 18 are diagrams illustrating the hood in a second position (retracted position) for explaining the arrangement for the opening/closing and movement of the hood.
Figure 19:
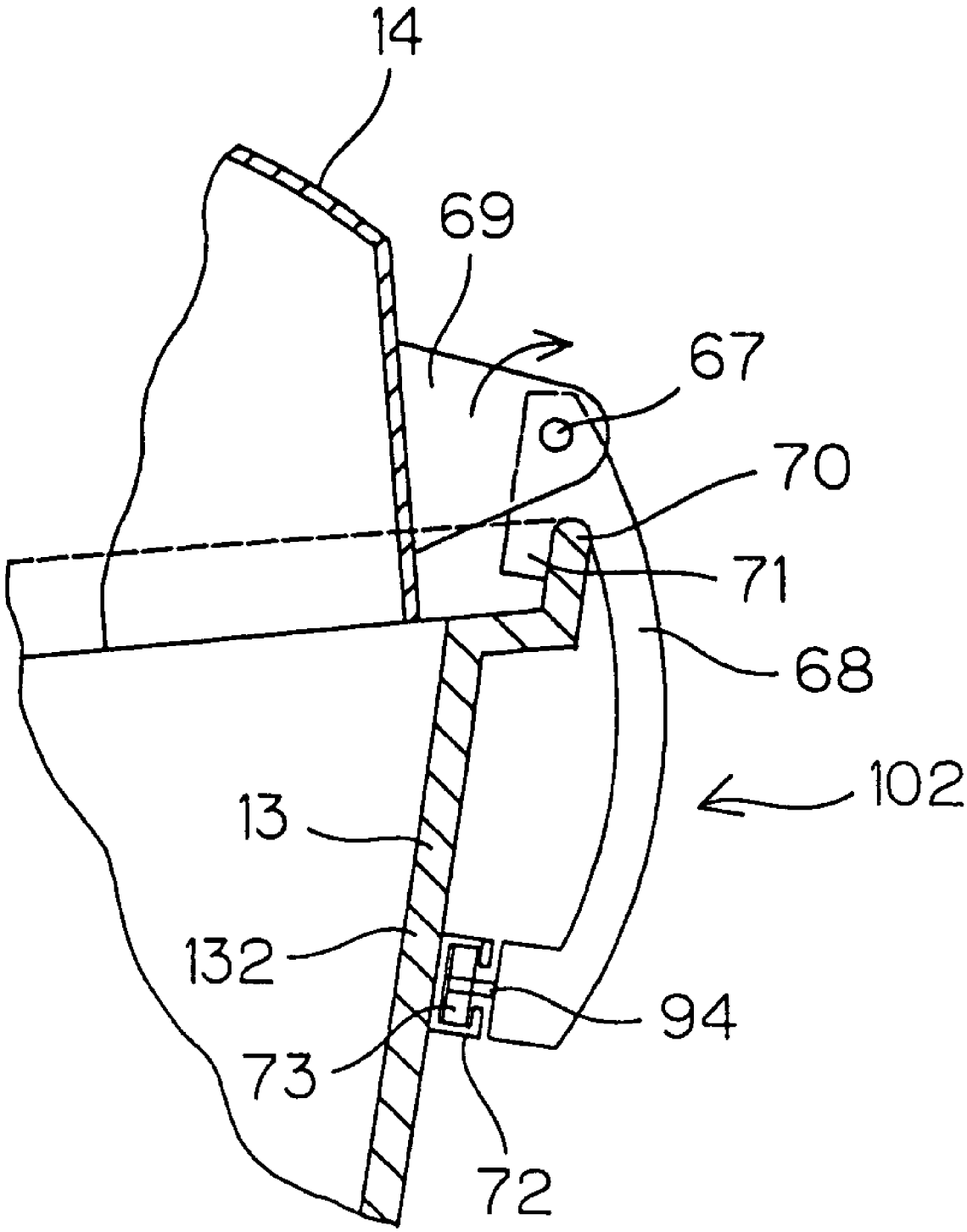
FIG. 19 is a diagram for explaining the specific construction of an open/close unit.
Figure 20:
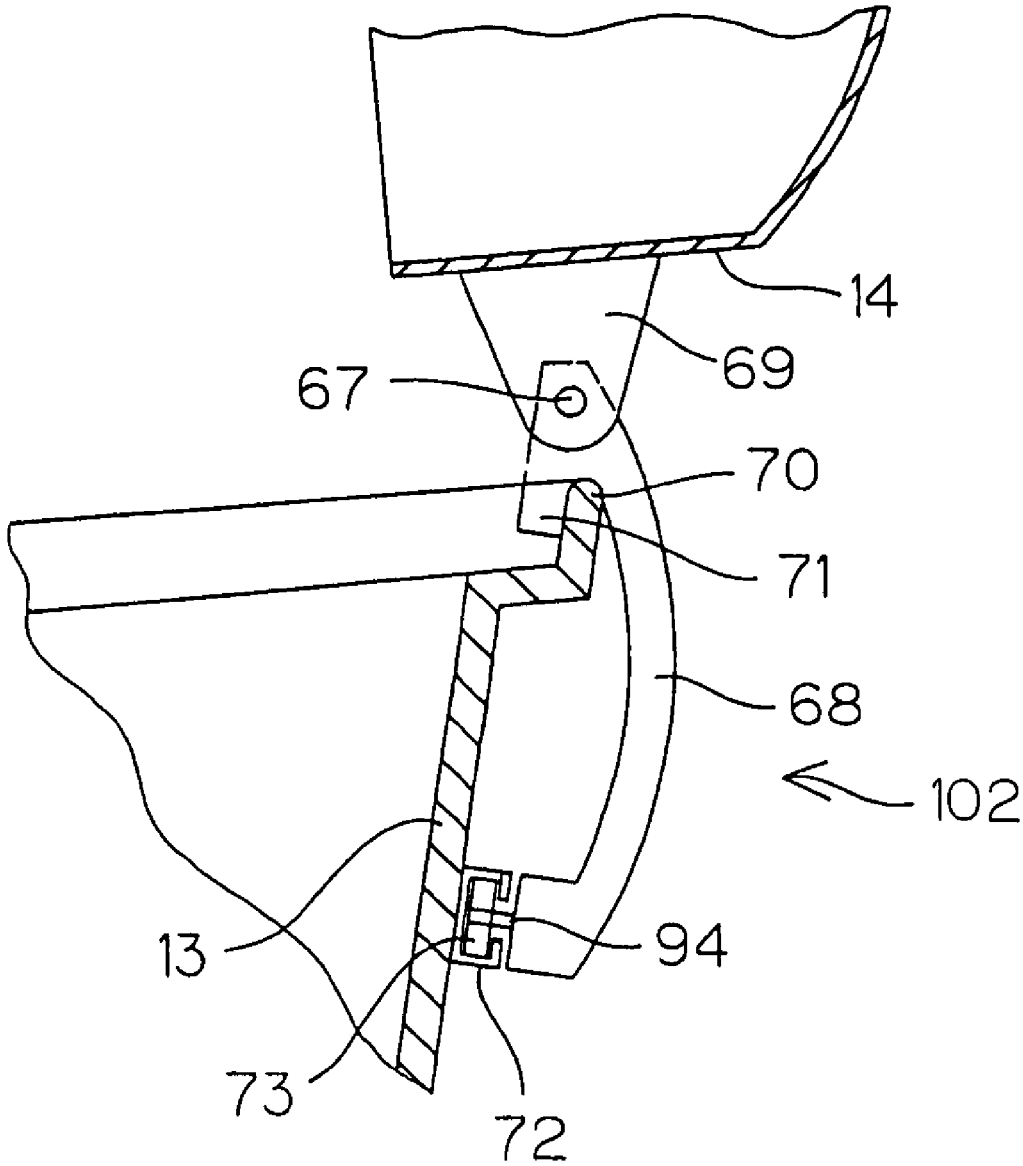
FIG. 20 is a diagram for explaining the specific construction of the open/close unit.
Figure 21:
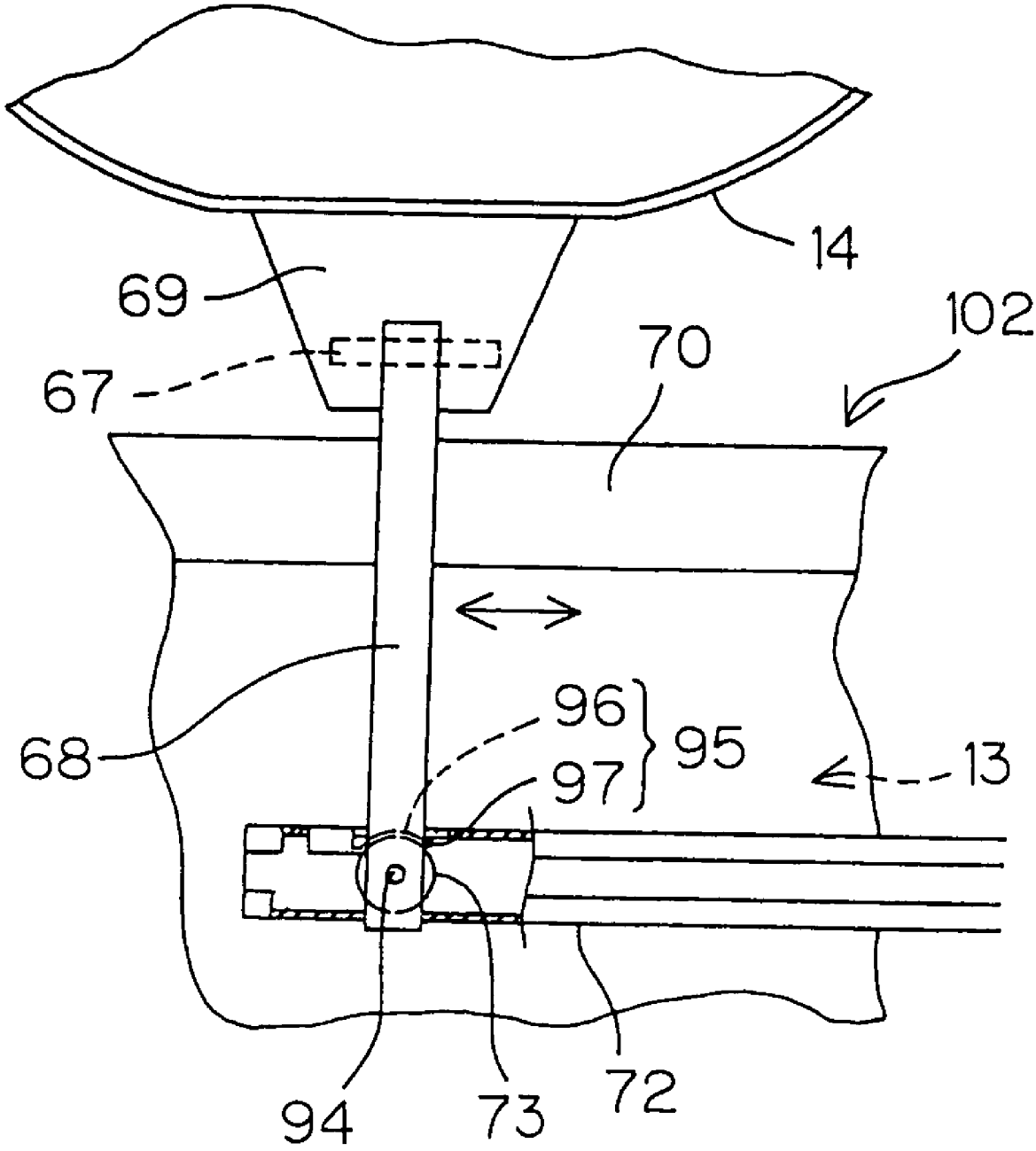
FIG. 21 is a diagram for explaining the specific construction of the open/close unit.
Figure 22:
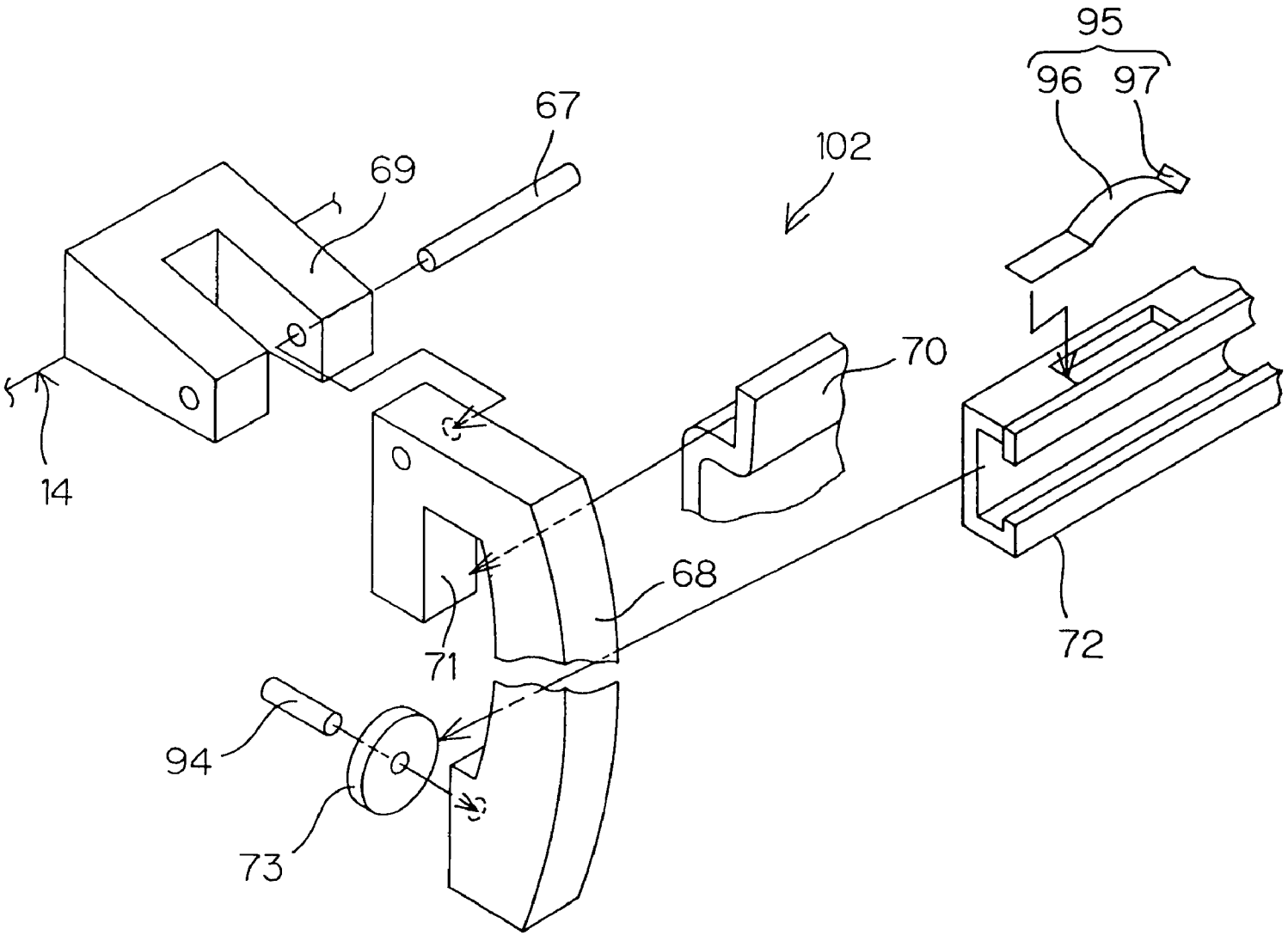
FIG. 22 is a diagram for explaining the specific construction of the open/close unit.

As shown in FIGS. 8, 10 and 18, the second position is such that the hood 14 does not cause any inconvenience when the operator performs the operations from the rear side of the basin 13. That is, the second position is a retracted position away from a rear upper side of the basin 13.

The second position, i.e., the retracted position, is a position on an upper left side of the basin 13 as seen from the front side in this embodiment. However, the second position is not limited to this position, but may be a position on an upper right side of the basin 13.

The hood 14 moved to the second position (retracted position) does not hinder to the operator who performs the operations from the rear side of the basin 13. Therefore, the operator can advantageously perform the operations, tasks and manipulation. Since the operations can be performed from the rear side of the person's head, the auxiliary shampooing operation can manually be performed by evenly applying forces on the left and right sides of the person's head. Further, the person's head can be seen well in the hair dyeing operation, so that the degree of the hair dyeing can easily be checked. Therefore, beautiful hair dye can be ensured. In addition, the operator is out of the person's sight during the operations, so that the operator does not oppress the person.

Next, the specific construction of the open/close unit 102 will be described with reference to FIGS. 18 to 22.

The open/close unit 102 includes a rotation center shaft 67 about which the hood 14 is pivotal, a support member 68 for supporting the rotation center shaft 67, and a support portion 69 provided on the hood 14 and coupled to the support member 68 via the rotation center shaft 67. The rotation center shaft 67 is disposed in association with the rear portion of the hood 14 in the closed state as extending laterally along the rear portion of the basin 13, and the hood 14 is pivotal about the axis of the rotation center shaft 67 as a support point. The support portion 69, the support member 68 and the rotation center shaft 67 constitute a hinge structure for opening and closing the hood 14. The hood 14 is pivoted about the support point to be opened rearward with the front portion thereof being lifted.

Further, the open/close unit 102 opens the hood 14 to the first position, and then slides the hood 14 to the left side of the basin 13 to guide the hood 14 to the second position. At this time, the hood 14 is guided to be moved along the guide rail 101. The guide rail 101 includes a first guide 70 and a second guide 72.

The first guide 70 is provided integrally with the upper peripheral portion of the basin 13, and slidably supports an abutment portion 71 provided on the support member 68. The abutment portion 71 is provided integrally with an upper portion of the support member 68.

The second guide 72 has a grooved cross section, and is fixed to the basin 13 as extending horizontally along the outer periphery of the basin 13. A roller 73 is fitted in a groove of the second guide 72 so as to roll on the groove. The roller 73 is supported rotatably about a shaft 94 at a lower position of the support member 68. The second guide 72 is disposed in predetermined vertically spaced relation with respect to the first guide 70 to firmly support the hood 14 in an upright state.

The support member 68 is a vertically elongated member. A middle portion of the support member 68 is spaced from the outer periphery of the basin 13 so that a hand can be inserted in a space defined between the support member and the basin. When the hood 14 is moved along the first guide 70 and the second guide 72, the support member 68 functions as a handle. The movement of the hood 14 may be achieved by holding the hood 14 by a hand.

In the open/close unit 102, the abutment portion 71 is guided along the first guide 70, while the roller 73 is rolled in the groove of the second guide 72. Thus, the support member 68 and, hence, the hood 14 can smoothly be moved from the first position to the second position.

A positioning member 95 for positioning the hood 14 is provided at the first position. The positioning member 95 includes an arcuate resilient member 96 to be fitted along the outer periphery of the roller 73, and an oblique projection 97 provided at an end of the resilient member 96 for facilitating engagement between the resilient member 96 and the roller 73. The resilient member 96 includes a pair of members to be fitted along the outer periphery of the roller 73 at opposite ends thereof with respect to the movement directions of the roller 73. The outer periphery of the roller 73 is fitted along the arcuate resilient member 96, and the roller 73 is held between the pair of members of the resilient member 96 for engagement. Thus, the roller 73 is positioned, while the movement of the roller in opposite guide directions is limited. When the roller 73 deforms the resilient member 96 to ride over the end of the resilient member, the roller 73 is disengaged from the resilient member 96, and permitted to freely rotate and move toward the second position. When the roller is moved from the second position to the first position, on the other hand, the roller 73 is pressed against the projection 97 to deform the resilient member 96 and ride over the projection. Thus, the roller 73 is positioned in engagement along the resilient member 96.

Since the hood 14 is thus retained at the first position and, particularly, positioned with respect to the laterally opposite movement directions, it is possible to accurately move the hood 14 with respect to the basin 13 and close the hood 14. Therefore, the hood 14 can properly be set with respect to the person's face after the person's neck is rested on the neck portion 11 at the predetermined position in the basin 13 in a preparatory operation for the automatic shampooing operation.

Though not particularly illustrated, the hood 14 is positioned at the second position without rattle or displacement by members provided in abutment against each other.

The construction of the open/close unit 102 is not limited to that described above, but one of the first guide and the second guide may be obviated.

Since the explanation referring to FIGS. 18 to 22 is focused on the construction of the open/close unit 102 for the opening/closing and movement of the hood 14, the shape of the open/close unit 102 slightly differs from that shown in FIG. 9.

In this embodiment, the lower edge of the hood 14 overlaps with the basin 13 as seen in plan when the hood in the open state is located at the first and second positions. Even if water droplets adhering on the interior surface of the hood 14 in the shampooing operation drip from the lower edge of the hood 14 when the hood 14 is opened into the upright state, the dripping water droplets fall within the basin 13. Therefore, the surroundings of the automatic shampoo machine 1 are not wetted.

The housing 3 covering the lower portion of the basin 13 is of a cone shape which has an outer diameter decreasing downward. Since the housing 3 defining the rear surface of the automatic shampoo machine 1 has the aforesaid shape, the housing 3 is less liable to hinder the operator standing behind the automatic shampoo machine 1. Further, the operator can easily move along the housing 3. Therefore, the operator can more easily perform the operations from the rear side.

Since the seat 2 is provided integrally in the aforesaid automatic shampoo machine 1, a part of the warm water reservoir tank 45 and the electrical box 17 can be located under the seat 2. Thus, the number of components to be disposed in a space below the basin 13 can be reduced, so that the housing 3 covering the lower portion of the basin 13 can be formed in the cone shape as described above.

Further, as shown in FIG. 8, the housing 3 has a recess 35 provided in the lowermost portion thereof as caving inward. Toes of the operator standing beside can be inserted in the recess 35. Thus, the operator can stand closer to the basin 13 and, hence, to the person's head, and more easily perform the operations from the rear side.

In the aforesaid automatic shampoo machine 1, the hood 14 is slid laterally along the basin 13 by the open/close unit 102 for facilitating the operations from the rear side, but the construction of the open/close unit is not limited thereto. As will be described in the following modifications, for example, the hood 14 may be moved to any other retracted position, and may be detachable. In the following modifications, components having the same construction as those of the automatic shampoo machine 1 previously described are denoted by the same reference characters, and no explanation will be given thereto. Different points will mainly be explained.

Figure 23:
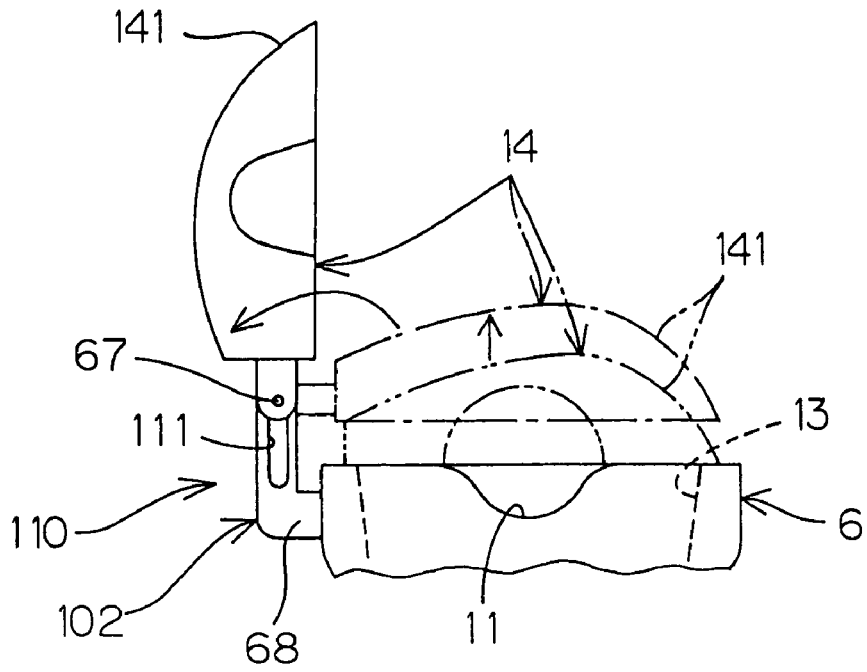
FIG. 23 is a diagram for explaining a modification of the arrangement for the opening/closing and movement of the hood.

In a modification shown in FIG. 23, the hood 14 is adapted to be opened from a closed state (indicated by a two-dot-and-dash line) pivotally about a rotation center shaft 67 provided as a support point on one lateral portion of the hood on the left side of the basin 13 so that a right portion 141 of the hood 14 is lifted. The hood 14 in an open state is indicated by a solid line. The hood 14 opened in this state does not interfere between the operator and the person. The support point may be located on the right side of the basin 13.

The rotation center shaft 67 has a lift mechanism 110 for lifting the hood 14 from the closed position. The hood 14 once lifted into a lifted position (indicated by a one-dot-and-dash line in FIG. 23) is pivoted into the aforesaid open state. The lift mechanism 110 includes a support member 68 having a vertical groove 111 which receives ends of the rotation center shaft 67 for guiding the rotation center shaft in a vertically movable manner. When the hood 14 is to be opened, the hood 14 which overhangs the person is once lifted, and then pivoted about the support point. The hood 14 does not influence the person's face when being opened. Thus, the hood 14 can smoothly be opened.

Figure 24:
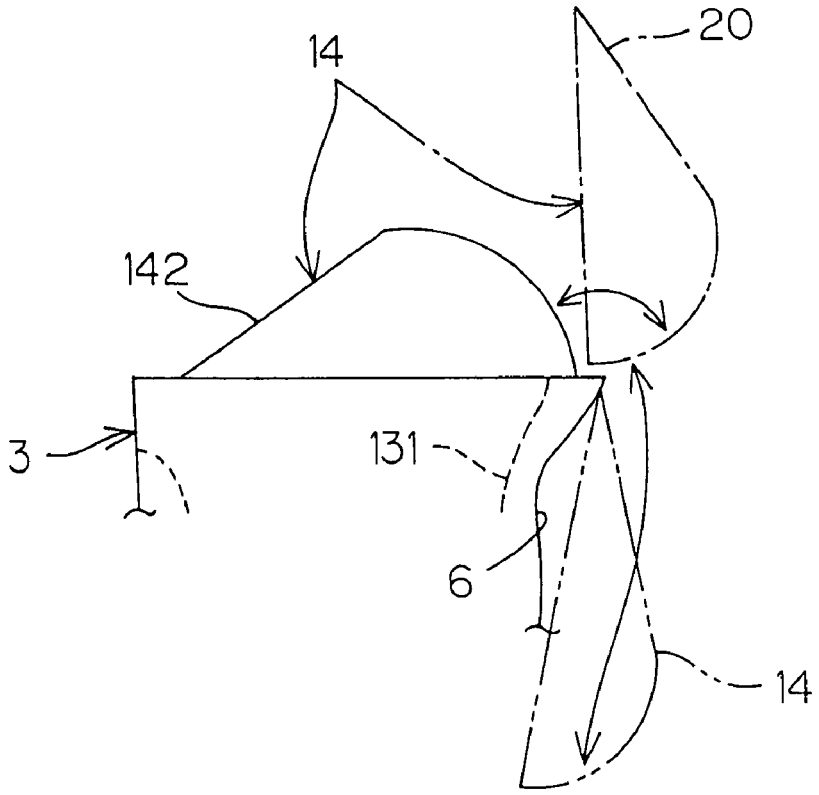
FIG. 24 is a diagram for explaining another modification of the arrangement for the opening/closing and movement of the hood.

FIG. 24 illustrates another modification. In this modification, the hood 14 is opened rearwardly of the basin 13 with a front portion 142 thereof being lifted (the hood 14 in this state is indicated by a one-dot-and-dash line), and then moved downward along a rear face 131 of the basin 13 (the hood 14 in this state is indicated by a two-dot-and-dash line). Specifically, a known arrangement including a link mechanism, a slide guide mechanism and the like may be utilized for moving the hood 14 and the rotation center shaft 67. The hood 14 in the open state is retracted on the rear lower side of the basin 13, so that the hood does not interfere between the operator standing behind the uncovered basin 13 and the person. The hood 14 may be retracted behind the housing 3 or in a space defined between the housing 3 and the basin 13. In this case, the cone-shaped housing 3 is advantageous for providing a space for housing the opened hood therein.

Further, the hood 14 may detachably be provided on the basin 13. The hood 14 may be removed from the basin 13 when unnecessary. Thus, the hood 14 does not interfere between the operator standing behind the basin 13 and the person. By removing the hood 14, the top of the basin 13 can be uncovered along the entire circumference of the basin. Therefore, the operator can perform the operations from the rear and lateral sides.

Although the automatic shampoo machine 1 has been described as including the seat 2 integrally provided therein according to the aforesaid embodiment, the automatic shampoo machine is not necessarily required to include the seat 2.

Figure 25:
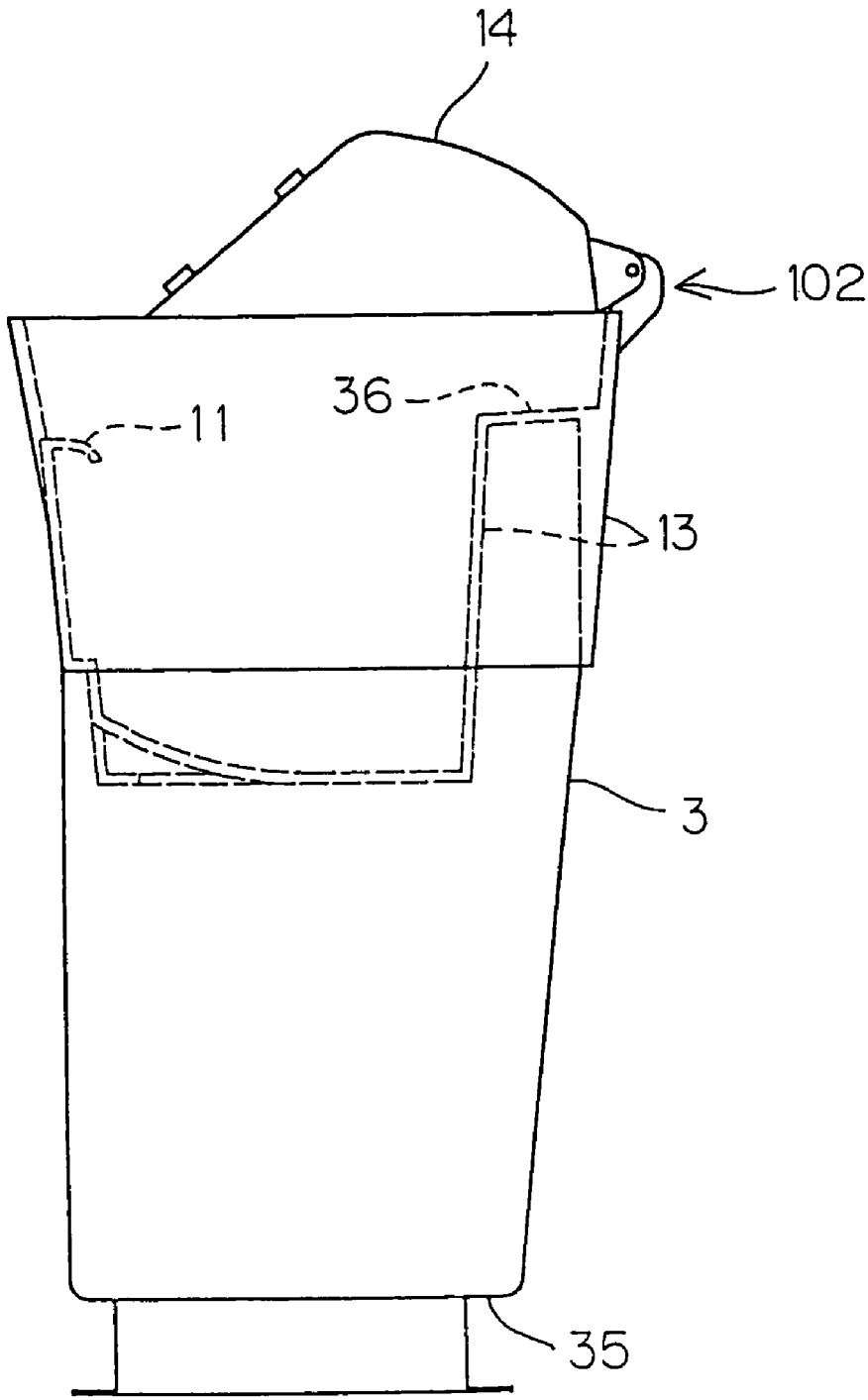
FIG. 25 is a diagram illustrating the construction of an automatic shampoo machine according to another embodiment of the invention.

For example, the automatic shampoo machine 1 may comprise the basin 13 and the housing 3 without the provision of the seat 2 as shown in FIG. 25. In this case, the warm water reservoir tank 45, the electrical box 17 and the like may be provided within the housing 3, or may separately be provided outside.

Besides, various modifications may be made within the scope of the present invention as defined by the following claims.

What is claimed is:

1. An automatic shampoo machine for automatically performing a shampooing operation by spouting a cleaning liquid over a head and hair of a person being shampooed, the automatic shampoo machine comprising:

a basin configured so that an operator stands behind the person's head for performing the shampooing operation, the basin having a top, a rear portion and an outer periphery, the person's head being positioned upward in the basin;

a hood for covering and uncovering the top of the basin, the hood having a front portion and a rear portion; and an open/close unit for opening and closing the hood with respect to the rear portion of the basin, the open/close unit being configured such that the front portion of the hood is lifted pivotally about the rear portion of the hood and, the hood being adapted to be slid from the rear portion of the basin along the outer periphery of the basin to a side of the basin after the hood is opened.

2. An automatic shampoo machine as set forth in claim 1, wherein an indentation is provided on a front upper edge of the basin for receiving a neck of the person assuming a supine attitude, and is configured so that at least a rear peripheral portion thereof is free from a projection which may otherwise hinder the operator when the operator stands behind the basin.

3. An automatic shampoo machine as set forth in claim 2, wherein the basin is configured so that at least a rear peripheral surface thereof comprises a generally round surface.

4. An automatic shampoo machine as set forth in claim 3, wherein the basin is configured so that at least the rear peripheral surface thereof has an outer diameter increasing upward.

5. An automatic shampoo machine as set forth in claim 1, wherein the basin is a ceramic basin.

6. An automatic shampoo machine as set forth in claim 1, comprising a cone-shaped housing for covering a lower part of the rear portion of the basin, said cone-shaped housing having an outer diameter decreasing downward.

7. An automatic shampoo machine as set forth in claim 6, comprising an operation panel, the operation panel being disposed in a lateral portion of the cone-shaped housing.

8. An automatic shampoo machine as set forth in claim 7, wherein the operation panel is provided in the form of a remote controller, and is detachable from the lateral portion of the cone-shaped housing for use.

9. An automatic shampoo machine as set forth in claim 7, wherein the operation panel is attached to an upper end of a support post provided in the automatic shampoo machine.

10. An automatic shampoo machine as set forth in claim 1, wherein the open/close unit comprises a guide rail for guiding the hood laterally off the basin, said guide rail fixed to the outer periphery of the basin.

11. An automatic shampoo machine as set forth in claim 1, comprising an agent container that contains an agent to be used for the shampooing operation, the agent container disposed in a free space below the basin.

12. An automatic shampoo machine as set forth in claim 1, comprising a hand shower and a hand shower valve disposed on a flat portion provided inwardly of a rear upper edge of the basin, which is at a position covered with the hood when the hood is closed.

13. An automatic shampoo machine as set forth in claim 1, comprising a seat provided in front of the basin for seating the person thereon for the shampooing operation.

14. An automatic shampoo machine as set forth in claim 13, wherein the seat is separable from a main body including the basin, and is combined with the main body at an installation site.

* * * * *